US006745467B1

(12) United States Patent
Terai et al.

(10) Patent No.: US 6,745,467 B1
(45) Date of Patent: Jun. 8, 2004

(54) METHOD OF PRODUCING A LIQUID DISCHARGE HEAD

(75) Inventors: Haruhiko Terai, Yokohama (JP); Masami Kasamoto, Ayase (JP); Hiroyuki Ishinaga, Tokyo (JP); Torachika Osada, Yamato (JP); Masashi Miyagawa, Yokohama (JP); Genji Inada, Yokohama (JP); Junji Tatsumi, Kawasaki (JP); Hiroyuki Sugiyama, Sagamihara (JP); Ken Ikegame, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/500,028

(22) Filed: Feb. 8, 2000

(30) Foreign Application Priority Data

Feb. 10, 1999 (JP) ..... 11-033269
May 27, 1999 (JP) ..... 11-148897
May 27, 1999 (JP) ..... 11-148899

(51) Int. Cl.[7] ..... B21D 53/76; B41J 2/16; B28D 1/48

(52) U.S. Cl. ..... 29/890.1; 29/611; 29/DIG. 47; 347/47; 347/56; 264/210.2; 264/280; 264/148; 264/154

(58) Field of Search ..... 29/890.1, 611, 29/25.35, 896.6, DIG. 47; 347/44, 47, 56; 264/280, 210.2, 153, 154, 148; 425/384, 394

(56) References Cited

U.S. PATENT DOCUMENTS 3,935,358 A * 1/1976 Wyeth et al. ..... 264/248 X
4,878,826 A * 11/1989 Wendt ..... 425/384
5,059,973 A 10/1991 Watanabe
5,160,577 A 11/1992 Deshpande
5,314,324 A * 5/1994 Wendt ..... 264/154 X
5,604,521 A 2/1997 Merkel et al. ..... 347/47
5,653,901 A 8/1997 Yoshimura ..... 219/121.71
5,919,411 A * 7/1999 Rezai et al. ..... 264/154
6,180,018 B1 1/2001 Miyagawa et al. ..... 216/27
6,447,984 B1 * 9/2002 Tatsumi et al. ..... 347/47 X
6,527,377 B1 * 3/2003 Ikegame et al. ..... 347/56

FOREIGN PATENT DOCUMENTS

JP 4-176657 * 6/1992 ..... 347/47
JP 6-190307 * 7/1994 ..... 29/890.1

OTHER PUBLICATIONS

Lee et al, "A Thermal Inkjet Printhead with a Monolithically Fabricated Nozzle Plate and Self–Aligned Ink Feed Hole", Journal o Microelectromechanical Systems, IEEE Transactions, vol. 8, No. 3, Sep. 1999, pp. 229–236.*
Patent Abstracts of Japan, vol. 017, No. 217, Apr. 28, 1993, JP 04–353456 A (Dec. 8, 1992).

* cited by examiner

*Primary Examiner*—A. Dexter Tugbang
(74) *Attorney, Agent, or Firm*—Fitzpatrick, Cella, Harper & Scinto

(57) ABSTRACT

A method for producing a liquid discharge head provided with a head main body including plural energy generating elements for generating energy for discharging liquid as a flying liquid droplet, and plural liquid paths in which the energy generating elements are respectively provided, and an orifice plate adjoined to the head main body and provided with plural discharge ports respectively communicating with the liquid paths and plural independent projections formed around the discharge ports and respectively corresponding to the discharge ports so as to enter into the liquid paths and to engage therewith. The method includes steps of forming the plural projections and the discharge ports while a continuous resinous film is transported; separating the film in a continuous manner in a predetermined size including the portion on which the discharge ports are formed, thereby preparing the orifice plate; and adjoining the orifice plate to the head main body.

9 Claims, 26 Drawing Sheets

METHOD OF PRODUCING A LIQUID DISCHARGE HEAD

BACKGROUND OF THE INVENTION

1. Field of the Invention

The present invention relates to a method for producing liquid discharge head for discharging liquid as a flying liquid droplet to deposit it on a recording medium thereby forming a record, a liquid discharge head produced by such method, a head cartridge and a liquid discharge recording apparatus including such liquid discharge head.

The present invention is applicable to an apparatus such as a printer for recording on a recording medium such as paper, yarn, fiber, fabrics, leather, metal, plastics, glass, timber, ceramics etc., a copying apparatus, a facsimile apparatus having communicating function, or a word processor having a printer unit, or an industrial recording apparatus combined in complex manner with various processing apparatus.

In the present invention, "recording" means not only providing the recording medium with a meaningful image such as a character or graphics but also providing with a meaningless image such as a pattern.

2. Related Background Art

The ink jet recording apparatus, effecting recording by discharging recording liquid (ink) from the orifice of the liquid discharge head, is already known to be excellent in low noise and high speed recording.

Such ink jet recording apparatus has been proposed in various systems, some of which are already commercialized and some are still under development for commercialization.

With the recent progress in the recording technology, there is being required recording of a higher speed and a higher definition, and the size of the discharge opening (orifice diameter) is becoming smaller with an arrangement of the orifices of a higher density. For this reason, there is being commonly employed an orifice forming method of employing a resinous film such as of polysulfone, polyethersulfone, polyphenylene sulfide or polyetherketone as the orifice plate and forming the orifice by fine working by excimer laser ablation on such resinous film.

However, it is extremely difficult to adjoin the orifice plate having a small orifice, without a gap, to the corresponding liquid path to be communicated with the orifice.

Consequently, there is adopted a method, as shown in FIG. 33, of forming a projection 245 in the vicinity of an orifice 241 on an orifice plate 240 at the side thereof at a main body 246 of the head and fitting such projection 245 or a part thereof into a flow path or liquid path 261. This method can prevent the intrusion of the adhesive resin into the orifice 241 or the liquid path 261. The formation of the projection 245 on the orifice plate 240 is executed by working with an excimer laser as in the formation of the discharge opening 241.

As explained in the foregoing, with the recent process in the recording technology, there is being required recording with a higher speed and a higher precision, and the number of nozzles is increasing in order to increasing the printing speed.

Therefore, there has been encountered a drawback that the orifice or the projection is not formed in the predetermined position.

SUMMARY OF THE INVENTION

In consideration of the foregoing, an object of the present invention is to provide a method for producing the liquid discharge head, capable of easily forming the orifice or the projection at the predetermined position with a high production yield, even in an orifice plate with a large number of nozzles.

Another object of the present invention is to provide a method for producing the liquid discharge head by adjoining an orifice plate having an orifice to a head main body having a liquid path by forming a projection around the orifice of the orifice plate and inserting such projection into the liquid path of the head main body, the method being free from defects such as an error in the pitch of the orifices or a defective shape of the orifice or a failure in the entry of the projection into the liquid path.

The present inventors have found that, by forming plural orifices and plural projections in continuous manner in the course of continuous transportation of a resinous film, the positioning for each orifice plate can be dispensed with, and the orifices and the projections can be formed in the predetermined positions since the continuous film is subjected to a tension during transportation.

The present inventors have also found that, in continuous formation of the plural orifices and the plural projections on the resinous film, the performance of the recording head is affected by the relationship between the direction of arrangement of the plural orifices and the plural projections on the resinous film and the longitudinal direction of the film.

Also in case of winding the film into a roll after the formation of the orifices and the projections, such projections, orifices or an adjoining face, to be adjoined to the head main body, around the projection may be crushed or damaged by overlapping of the film in the wound state, and such drawbacks have to be prevented for producing the satisfactory head.

According to the present invention, such drawbacks can be prevented by a method for producing a liquid discharge head provided with:

- a head main body including plural energy generating elements for generating energy for discharging liquid as a flying liquid droplet, and plural liquid paths in which the energy generating elements are respectively provided; and
- an orifice plate provided with plural discharge ports respectively communicating with the liquid paths and plural independent projections formed around the discharge ports and respectively corresponding to the discharge ports so as to enter into the liquid paths and to engage therewith, and adjoined to the head main body, the method comprising:
  - a step of forming plural projections and the discharge ports while a continuous resinous film is transported;
  - a step of separating the film in continuous manner in a predetermined size including the portion where the discharge ports are formed, thereby preparing the orifice plate; and
  - a step of adjoining the orifice plate to the head main body.

DESCRIPTION OF THE PREFERRED EMBODIMENTS

Now the present invention will be clarified in detail by preferred embodiments thereof, with reference to the attached drawings.

First Embodiment

Figure 1:
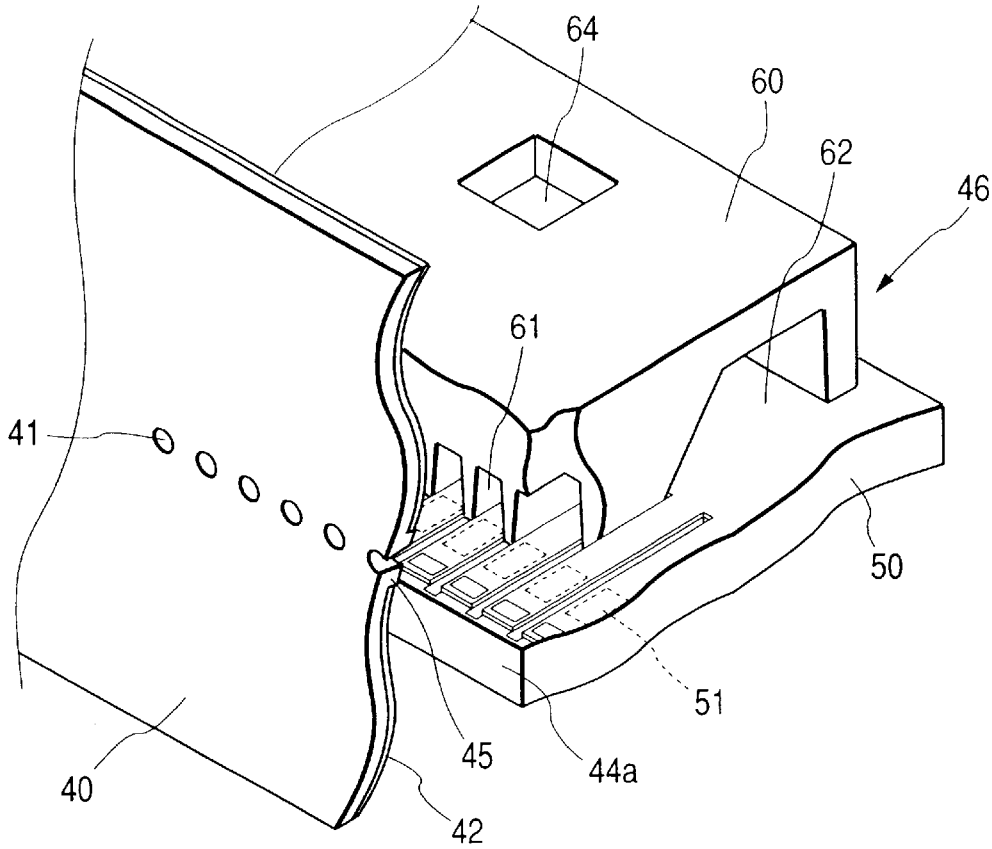
FIG. 1 is a perspective view showing a liquid discharge head in which applicable is the producing method constituting a first embodiment of the present invention for producing the liquid discharge head.
Figure 2:
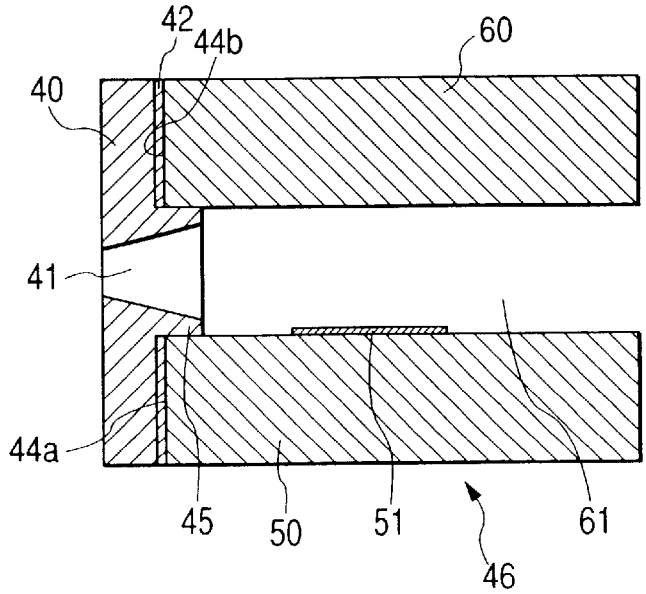
FIG. 2 is a cross-sectional view along the direction of the liquid path of the liquid discharge head shown in FIG. 1.

FIG. 1 is a perspective view showing a liquid discharge head in which applicable is the producing method constituting a first embodiment of the present invention. FIG. 2 is a cross-sectional view along the direction of the liquid flow path of the liquid discharge head shown in FIG. 1.

The liquid discharge head produced by the producing method of the present invention is composed, as shown in FIG. 1, a main body 46 of the head formed by adjoining a ceiling plate 60 onto a base plate 50, and an orifice plate 40 adhered to the front end face of the main body 46. The base plate 50 (hereinafter also called heater board) is provided with plural energy generating elements 51 (hereinafter also called heaters) for generating thermal energy to be used for discharging liquid such as ink, and Al wirings for supplying the energy generating elements 51 with electrical signals. The base plate 50 is obtained by forming, on an Si substrate, plural energy generating elements 51 and the Al wirings by a film forming technology.

On a surface of the ceiling plate 60, there are formed grooves for constituting plural liquid paths 61 in which the energy generating elements 51 are to be respectively provided, and a groove for constituting a liquid chamber 62 for temporarily storing the ink to be supplied to the respective liquid paths 61. The ceiling plate 60 is further provided with a supply aperture 64 for supplying the liquid chamber 62 with ink. The head main body 46 provided with the plural liquid paths 61 and the plural energy generating elements 51 is obtained by adjoining the base plate 50 and the ceiling plate 60 in such a manner that the energy generating elements are respectively positioned in the plural liquid paths 61. The liquid paths 61 are opened on a front end face of the head main body 46, namely, as shown in FIG. 2, a face including an adjoining face 44*a* of the base plate 50 with the orifice plate 40 and an adjoining face 44*b* of the ceiling plate 60 with the orifice plate 40.

On the other hand, the orifice plate 40 is provided with plural discharge openings (hereinafter also called orifices) 41 to communicate respectively with the liquid paths 61.

Also around the orifices 41 in the adjoining face of the orifice plate 40 with the head main body 46, there are provided plural projections 45 which are formed independently for the respective orifices 41. In a state where the projections 45 respectively enter the liquid paths 61 and are fitted therewith, the orifice plate 40 is adhered to the adjoining faces 44*a*, 44*b* by adhesive resin 42.

In this liquid discharge head, the thermal energy generated from the energy generating element 51 acts on the ink in the liquid path 61, thereby generating a bubble on the energy generating element 51 and discharging ink from the orifice 41, utilizing such bubble generation.

Figure 3:
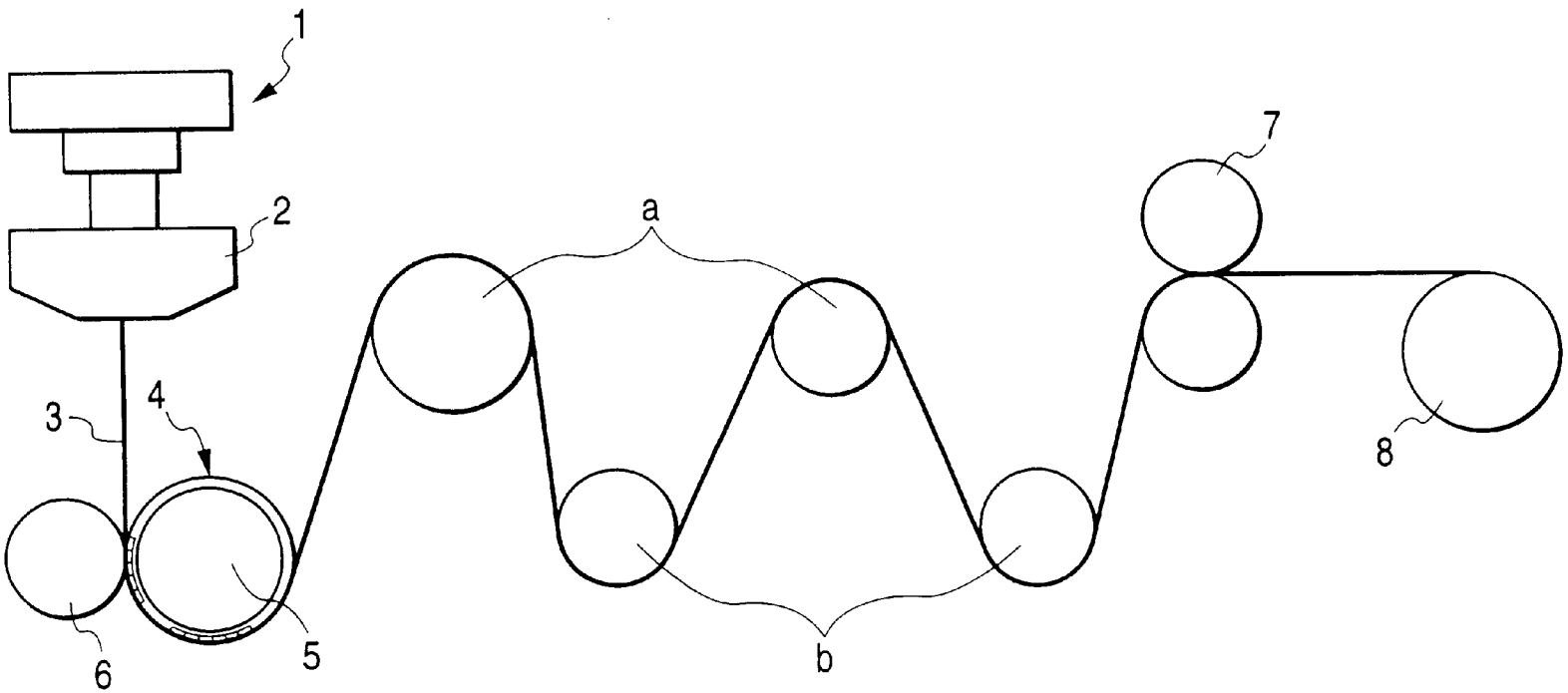
FIG. 3 is a schematic view showing a part of the manufacturing line to be used in the producing method for the liquid discharge head constituting the first embodiment of the present invention.

FIG. 3 is a schematic view showing a part of the manufacturing line to be employed in the producing method for the liquid discharge head, in the first embodiment of the present invention. The manufacturing line shown in FIG. 3 is used for producing the orifice plate shown in FIGS. 1 and 2. In this manufacturing line, fused resin is extruded in a film, and a roller provided with relief molds of a predetermined shape is pressed onto the surface of thus extruded resinous film, thereby forming the pattern of desired shape on the surface of the resinous film.

As shown in FIG. 3, a die 2 of an extruder 1 extrudes the fused resin in a film shape to obtain a resinous film 3, which is then pinched between and pressed by a cooling roller 5 and a nip roller 6. The cooling roller 5 is surfacially provided with a relief mold 4 of a shape corresponding to the orifice 41 and the projection 45 shown in FIGS. 1 and 2, and such relief mold 4 forms desired shapes in continuous manner on the surface of the resinous film 3.

The resinous film 3, subjected to surfacial formation of the desired shape by the relief mold 4 and cooled by the cooling roller 5, passes certain rollers and two drawing rollers 7 and wound into a roll by a winding roller 8, in such a manner that the projections 45 are directed toward the outside of the winding roller 8.

In the producing method for the liquid discharge head of the present embodiment, there was employed polysulfone resin (Udel P3900 supplied by Amoco Co.) as the resinous material to be extruded from the extrusion molder 1. The resinous material to be extruded from the extrusion molder 1, or to constitute the resinous film 3, is preferably composed of a thermoplastic polymer. More specifically, the resinous film 3 is preferably composed of any of polyethersulfone, polyphenylene sulfide and polyetherketone.

In the following there will be explained the method for preparing the orifice plate 40.

At first, the polysulfone resin is extruded from the die 2 with a thickness of 500 $\mu$m under the following working conditions (A), to obtain the resinous film 3. The resinous film 3 is cooled by pressing between the cooling roller 5 of a temperature of 15° C. surfacially provided with the relief molds 4 and the nip roller 6:

Extruding conditions (A):

die aperture 0.5 mm;

extruder set temperature 315° C. at the rear part, 360° C. at the intermediate part and 370° C. in the head and die;

cooling roller temperature 15° C.;

extrusion thickness 50 $\mu$m;

nip pressure (air gauge pressure) 2 kgf/cm$^2$.

Figure 4A:
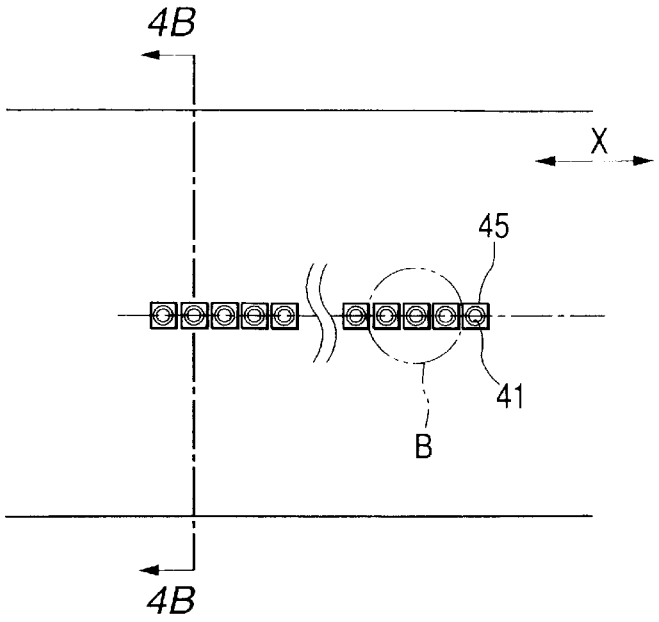
FIGS. 4A and 4B are respectively a plan view and a cross-sectional view of a resinous film prepared by the manufacturing line shown in FIG. 3.
Figure 4B:
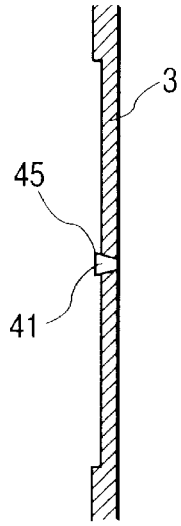
Figure 5A:
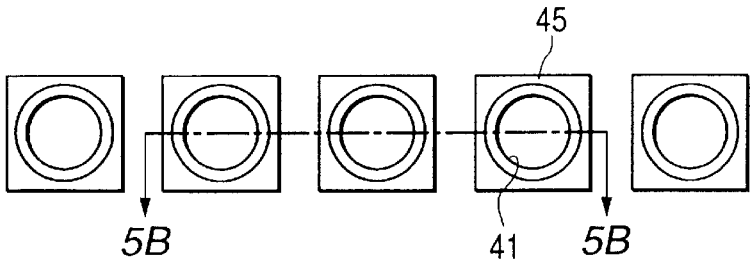
FIGS. 5A and 5B are respectively a plan view and a cross-sectional view of a resinous film prepared by the manufacturing line shown in FIG. 3.
Figure 5B:
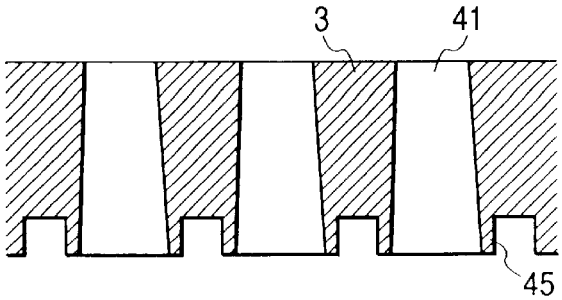

FIGS. 4A, 4B, 5A and 5B are respectively a plan view and a cross-sectional view of the resinous film 3 produced by the manufacturing line shown in FIG. 3. FIG. 4A is a plan view of the resinous film 3, and FIG. 4B is a cross-sectional view along a line 4B—4B in FIG. 4A. Also FIG. 5A is a magnified plan view of a portion B of the resinous film shown in FIG. 4A, and FIG. 5B is a cross-sectional view along a line 5B—5B in FIG. 5A. By pressing the surface of the resinous film 3 with the relief mold 4 of the cooling roller 5, an orifice 41 and a projection 45 are simultaneously formed in continuous manner and in plural units along the longitudinal direction X of the extruded resinous film 3 as shown in FIGS. 4A, 4B, 5A and 5B. In the present embodiment, the orifices 41 and the projections 45 of a line are formed in plural units and in continuous manner along the longitudinal direction of the film, but there may also be formed plural lines parallel to the longitudinal direction.

The pitch of the projections 45 corresponds to a resolution of 600 dpi, and the projections 45 have an external shape of a rectangular pillar. The projection 45 has an external dimension of 30×30 $\mu$m with a height of 10 $\mu$m. The orifice 41 has a truncated conical shape, with a diameter of 25 $\mu$m on the end face of the orifice 41 at the side of the projection 45 and a diameter of 20 $\mu$m on the end face at the opposite side. The relief mold 4 is so prepared that the orifice 41 and the projection 45 of the above-described shapes and dimensions are simultaneously formed in continuous manner on the resinous film 3.

After the formation of the orifices 41 and the projections 45 by the relief mold 4 on the resinous film 3, a water-repellent layer is formed on a surface (front surface) of the resinous film 3 opposite to the projections 45. The water-repellent treatment was conducted with CTX-CZ5A supplied by Asahi Glass Co. After the front surface is made hydrophilic by a corona treatment, the water-repellent agent is coated with a microgravure coater supplied by Yasui Seiki Co., while the resinous film 3 is unwound in the longitudinal direction. There were conducted in succession a step of coating the water-repellent agent so as to obtain a water-repellent layer of a final thickness of 0.1 $\mu$m, and a step of prebaking the coated water-repellent agent at 80° C. The resinous film 3 wound in a roll after such coating and prebaking steps is heated at 150° C. for 5 hours in an oven to complete the water-repellent layer on the front face of the resinous film 3.

In the producing method of the present embodiment for the liquid discharge head, the step of pressing the resinous film 3 with the relief mold 4 and the step of forming the water-repellent layer on the resinous film 3 are conducted separately, but these two operations may be executed in a single step. For example, the step of pressing the resinous film 3 with the relief mold 4 may be conducted while the water-repellent agent is supplied to the surface of the resinous film at the side of the nip roller, thereby forming the water-repellent layer on such surface. Otherwise, in a position before the winding of the resinous film 3 by the winding roller 8, there can be provided a coating roller for coating the water-repellent agent, thereby coating the resinous film 3 with the water-repellent agent.

The resinous film 3, subjected to the formation of the orifices 41 and the projections 45 and wound in a roll, is cut into a size required for each liquid discharge head, whereby the orifice plate 40 shown in FIGS. 1 and 2 can be prepared.

In the following there will be explained the producing method for the liquid discharge head after the preparation of the orifice plate 40.

After the preparation of the orifice plate 40, it is adjoined, with an adhesive material, to the head main body 46 prepared in a separate step. There is employed epoxy adhesive that can be shifted to a B-stage (hardened intermediate state) while retaining tucking property (viscous property) by ultraviolet (UV) irradiation, and, after hardening with shrinkage, can achieve adhesion of components by pressing under heating or by additional UV irradiation. Also there is known such adhesive that can achieve adhesion by pressing under heating only, without passing through the B-stage state.

At first the above-described epoxy adhesive is transferred, by a transfer method, onto the adjoining faces 44*a*, 44*b* of the head main body 46. Then the transferred adhesive is irradiated with ultraviolet light of 1 mW/cm$^2$ for 60 seconds to shift the adhesive to the B-stage state, thereby completing the hardening with shrinkage of the adhesive while retaining the tuck property.

Then the projections 45 of the orifice plate 40 are respectively inserted into the corresponding liquid paths 61 whereby the projections 45 are fitted with the end portions of the liquid paths 61. The fitting between the projections 45 and the liquid paths 61 is executed with a gap.

Then a load of 1 kg/cm$^2$ is applied to the orifice plate 40 on the surface thereof opposite to the projections 45, thereby maintaining the orifice plate 40 and the head main body 46 in close contact, and, while such state is maintained, the head main body 46 is pressed to the orifice plate 40 under heating at 60° C. thereby completing the hardening of the adhesive.

The liquid discharge head shown in FIGS. 1 and 2 can be prepared through the above-described steps. In the producing method of the present embodiment for the liquid discharge head, since plural orifice and plural projections are arranged along the longitudinal direction of the film, the orifice plate can be prepared in any size, without limitation in the width of the film. Therefore, as it is unnecessary to adjoin plural orifice plates, there is not observed the defective printing resulting from the crosstalk between the neighboring nozzles induced by the peeling or defective adhesion at the adjoining portion, or the defective printing resulting from the aberration in the landing positions of the liquid droplets induced by the positional aberration between the mutually adjoined two orifice plates. Also there can be obtained an orifice plate with improved thickness distribution of the water-repellent layer.

Second Embodiment

Figure 6A:
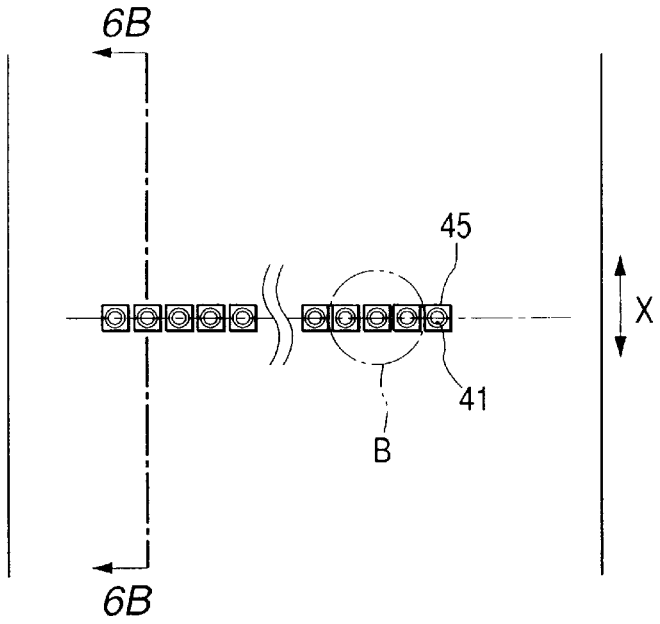
FIGS. 6A and 6B are views showing the producing method for the liquid discharge head, constituting a second embodiment of the present invention.
Figure 6B:
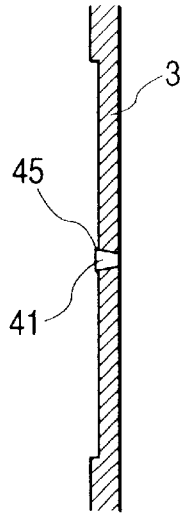

FIGS. 6A and 6B are respectively a plan view and a cross-sectional view showing another example of the resinous film prepared by the manufacturing line shown in FIG. 3.

In the present embodiment, in forming the orifice 41 and the projection 45 by extrusion molding of the resinous film 3, the row of the orifices 41 and the projections 45 is formed perpendicularly to the longitudinal direction (X) of the film as shown in FIG. 6A, in contrast to the first embodiment.

According to the method of the present embodiment, since the orifice and the projection are arranged in plural units perpendicularly to the longitudinal direction of the film, the pitch of the orifices or projections can be made free of error even in case a thin film is elongated or becomes slack in the transportation of the film or in the still state thereof.

Third Embodiment

FIGS. 7A, 7B and FIGS. 8A to 8F are views showing the producing method for the liquid discharge head, in a third embodiment of the present invention. The method of the present embodiment is to prepare a liquid discharge head similar in configuration and shape to that of the first embodiment, and is principally different from the method of the first embodiment in that the orifice is prepared by laser working. In the following there will be principally explained the differences from the first embodiment.

Figure 7A:
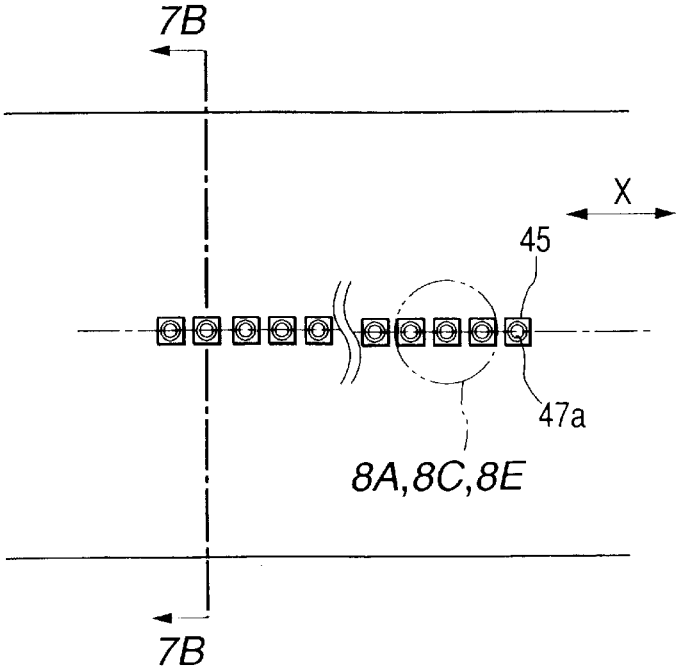
FIGS. 7A and 7B are views showing the producing method for the liquid discharge head, constituting a third embodiment of the present invention.
Figure 7B:
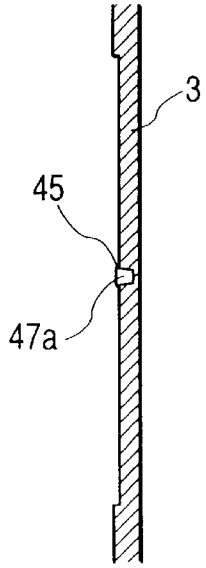
Figure 8A:
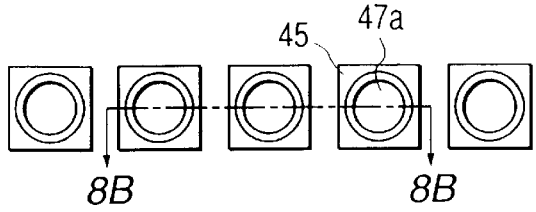
FIGS. 8A, 8B, 8C, 8D, 8E and 8F are views showing the producing method for the liquid discharge head, in the third embodiment of the present invention.
Figure 8B:
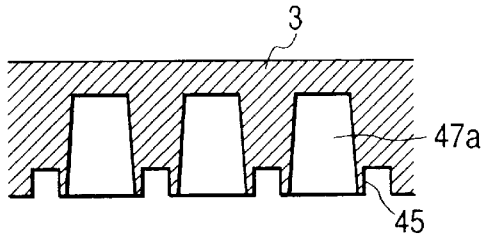

Also in the producing method of the present embodiment, a resinous film for preparing the orifice plate is molded by the manufacturing line of the first embodiment shown in FIG. 3. There is however employed a cooling roller 5 provided with a relief mold of another predetermined shape, instead of the relief mold 4 employed in the first embodiment. FIG. 7A is a plan view of the resinous film molded into a predetermined shape, by pressing with the above-described relief mold provided on the cooling roller 5, and FIG. 7B is a cross-sectional view along a line 7B—7B in FIG. 7A. FIG. 8A is a magnified plan view of a portion 8A of the resinous film shown in FIG. 7A, and FIG. 8B is a cross-sectional view along a line 8B—8B in FIG. 8A.

At first a resinous film 3 is formed by extruding polysulfone resin from the die 2 with a thickness of 50 $\mu$m, with the extruding conditions (A) same as those in the first embodiment. The resinous film 3 is then cooled, simultaneous with pressing with the cooling roller 5 of 15° C. surfacially provided with the above-mentioned relief mold and the nip roller 6. Thus, by the relief mold provided on the cooling roller 5, independent plural projections 45 and plural recesses 47*a* respectively positioned at the centers of the projections 45 are formed in continuous manner along the longitudinal direction of the resinous film 3 as shown in FIGS. 7A, 7B, 8A and 8B. In the present embodiment, the projections 45 and the recesses 47*a* are continuously formed in a single row along the longitudinal direction of the film, but there may be formed plural rows parallel to the longitudinal direction (X) of the film. Each recess 47*a* is to form the orifice 41. The pitch and the external dimension of the projections 45 are same as those in the first embodiment, and the recesses 47*a* have a depth of 40 $\mu$m. The relief mold provided on the cooling roller 5 is so prepared that such projection 45 and the recess 47*a* are simultaneously formed on the resinous film 3.

Then the water-repellent layer is formed, by a method similar to that in the first embodiment, on a surface (front surface) of the resinous film 3 opposite to the projections 45. As the water-repellent agent, there was employed CTX-CZ5A supplied by Asahi Glass Co.

Figure 8C:
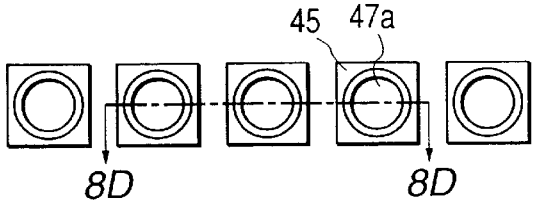

In the following there will be explained, with reference to FIGS. 8A to 8F, the process for preparing the orifice plate after the formation of the water-repellent layer on the resinous film 3. FIGS. 8C and 8E are magnified plan views of portions 8C, 8E of the resinous film shown in FIG. 7A, while FIG. 8D is a cross-sectional view along a line 8D—8D in FIG. 8C, and FIG. 8F is a cross-sectional view along a line 8F—8F in FIG. 8E.

Figure 8D:
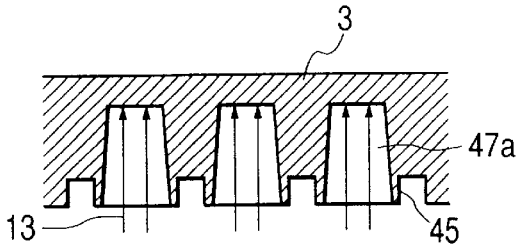
Figure 8E:
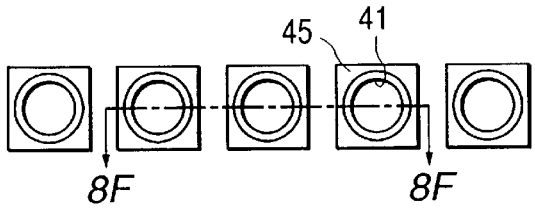
Figure 8F:
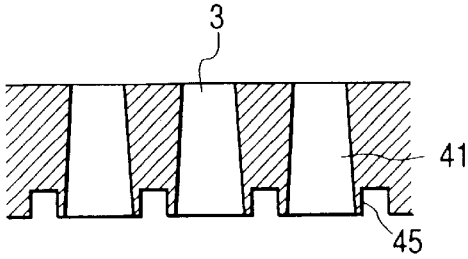

As shown in FIG. 8D, the bottom face of each recess 47*a* is irradiated with a laser beam 13 to form a hole penetrating through the resinous film 3, at the bottom face of each recess 47*a* as shown in FIGS. 8E and 8F. Thus there is formed, in the resinous film 3, an orifice 41 with an aperture diameter of 20 $\mu$m at a side opposite to the projection 45.

Figure 9:
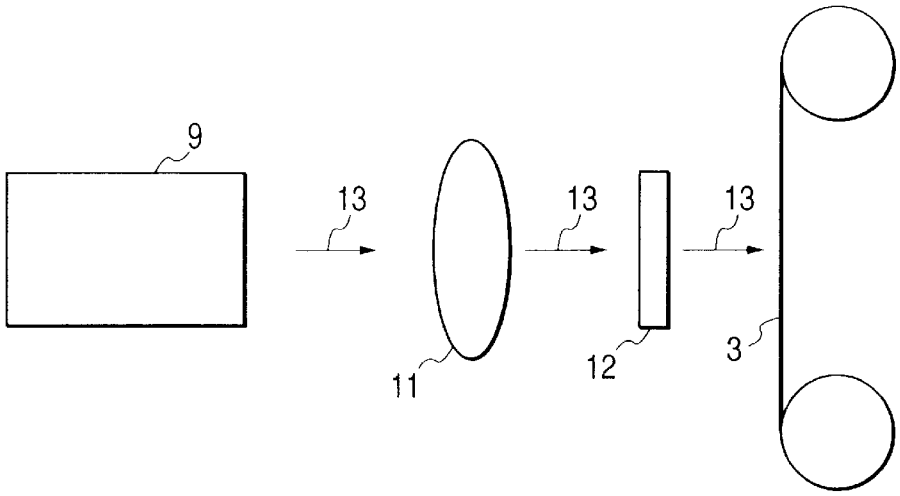
FIG. 9 is a schematic view of a laser working apparatus for forming the orifice in the resinous film.

FIG. 9 is a schematic view of a laser working apparatus for forming the orifice 41 in the resinous film 3. In the laser working apparatus shown in FIG. 9, there are provided an excimer laser oscillator 9, a condenser lens 11 for condensing the laser beam 13 emitted from the excimer laser oscillator 9, and a mask 12 irradiating a predetermined portion of the resinous film 3 with the laser beam 13. The laser beam 13 from the oscillator 9 is guided through the condenser lens 11 and the mask 12 and irradiates the resinous film 13. The resinous film 3 is stored in a rolled state, and a part of the resinous film 3 is unwound and extended flat, and the laser beam 13 irradiates such flat portion of the resinous film 3.

In the present embodiment, the manufacturing line shown in FIG. 3 and the laser working apparatus shown in FIG. 9 are formed separately, but the laser working apparatus shown in FIG. 9 may be provided in front of the winding roller 8 in the manufacturing line shown in FIG. 3.

In case the depth of the recess 47*a* is made large with respect to the thickness of the resinous film 3 thereby reducing the film thickness for opening the orifice 41 by the laser beam 13 to a required dimensional tolerance, the irradiating portion of the laser beam 13 need not be aligned with the bottom face of the recess 47*a* but the entire bottom face of the recess 47*a* can be irradiated with the laser beam 13. Thus there can be simplified the process for forming the orifice 41, thereby reducing the manufacturing cost of the liquid discharge head and that of the manufacturing apparatus.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, plural orifices, obtained by forming plural recesses in the respective centers of the plural projections by extrusion molding of the film and irradiating the bottom faces of such recesses with the laser beam, are arranged along the longitudinal direction of the film, so that the orifice plate can be prepared in any size, without limitation in the width of the film. Therefore, as it is unnecessary to adjoin plural orifice plates, there is not observed the defective printing resulting from the crosstalk between the neighboring nozzles induced by the peeling or defective adhesion at the adjoining portion, or the defective printing resulting from the aberration in the landing positions of the liquid droplets induced by the positional aberration between the mutually adjoined two orifice plates. Also there can be obtained an orifice plate with improved thickness distribution of the water-repellent layer.

Fourth Embodiment

Figure 10A:
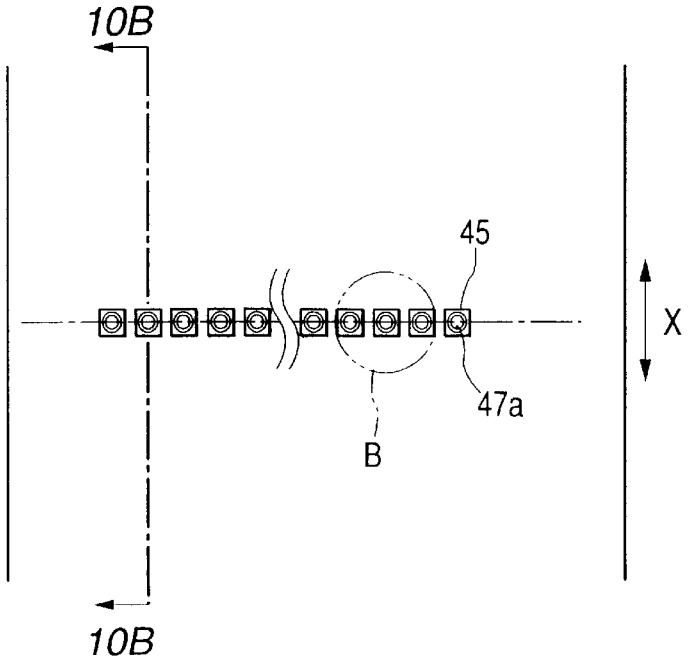
FIGS. 10A and 10B are views showing the producing method for the liquid discharge head, constituting a fourth embodiment of the present invention.
Figure 10B:
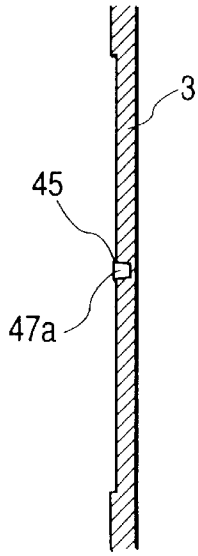

FIGS. 10A and 10B are views showing a method constituting a fourth embodiment of the present invention.

In the present embodiment, the orifice is formed, as in the second embodiment, by irradiating, with the laser beam, the bottom face of the recess 47*a* positioned at the center of the projection 45 on the resinous film 3, but the present embodiment is different from the second embodiment in that the projections 45 and the recesses 47*a* are arranged in a direction perpendicular to the longitudinal direction of the film, as shown in FIG. 10A.

According to the method of the present embodiment, the orifices, obtained by forming the plural projection and the plural recesses at the respective centers of the projections by extrusion molding of the film and irradiating the bottom faces of the recesses with the laser beam, are arranged in plural units perpendicularly to the longitudinal direction of the film, so that the pitch of the orifices or projections can be made free of error even in case a thin film is elongated or becomes slack in the transportation of the film or in the still state thereof.

Fifth Embodiment

In the present embodiment, polyparaphenylene terephthalamide was employed as the material of the film for preparing the orifice plate.

Polyparaphenylene terephthalamide (PPTA) is featured by a low thermal expansion rate (close to the linear expansion coefficient of Si) and a high elastic modulus (ca. 1500 kg/mm$^2$). As the energy generating elements of the head main body are provided on an Si substrate, the orifice plate composed of polyparaphenylene terephthalamide has a linear expansion coefficient close to that of the head main body, so that the distortion, peeling or positional aberration resulting from the difference in the linear expansion does not occur when the temperature is elevated or lowered. Also the high elastic modulus provides a high rigidity, so that the front surface can be maintained flat even if the orifice plate is made thinner. A thinner orifice plate facilitates formation of the orifice with the laser. Also polyparaphenylene terephthalamide shows satisfactory ablation property with the excimer laser, and a low linear expansion coefficient. Therefore the dilatation of the orifice plate by the heat at the laser working can be made small, so that the precision of the orifice hole can be improved.

Figure 11A:
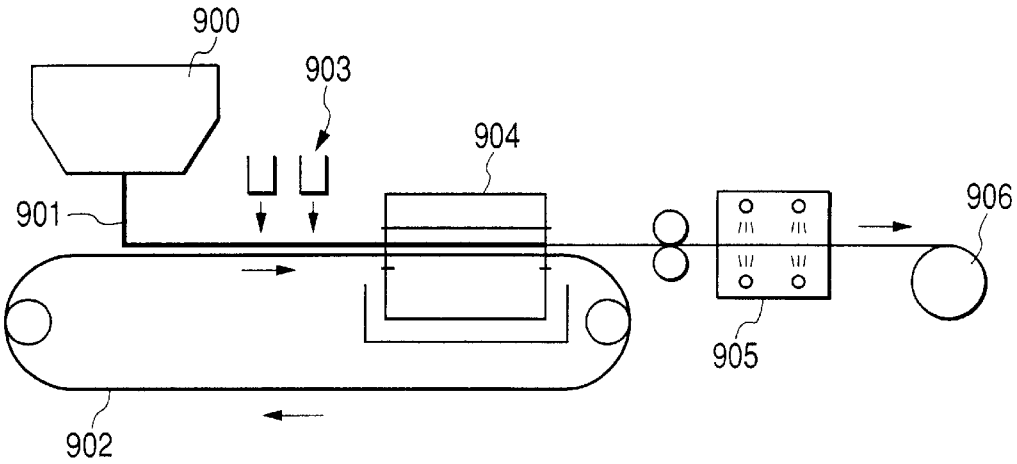
FIGS. 11A and 11B are schematic views showing an apparatus applied to the producing method for the liquid discharge head, in a fifth embodiment of the present invention.
Figure 11B:
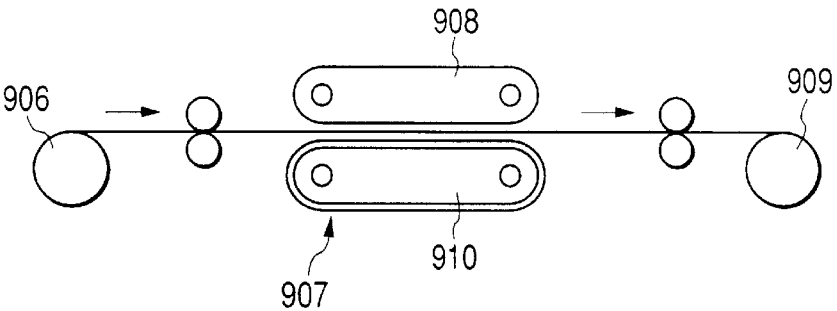

In the following there will be explained the preparation of an orifice plate composed of PPTA, with reference to FIGS. 7A, 7B, 8A , 8B, 9 and FIGS. 11A and 11B. FIGS. 11A and 11B are schematic views of a manufacturing line to be employed in the present embodiment.

In the apparatus shown in FIG. 11A, PPTA is dissolved in concentrated sulfuric acid to obtain dope 901, which is degassed, filtered, and supplied and extended from a die 900 with a slit onto a tantalum belt 902 under air blowing from an air nozzle 903. It is then solidified by guiding into diluted sulfuric acid in a diluted sulfuric acid overflow tank 904. The solidified sheet is peeled off from the belt, then rinsed in a rinsing tank 905 and wound. While it is in the moist state, it is set in the unwinding position of a heating/cooling roller 910 of the apparatus shown in FIG. 11B. The roller is surfacially provided with a relief mold 907 of a predetermined shape. The film of polyparaphenylene terephthalamide resin is pressed by the relief mold of the heating/cooling roller 910 to obtain a resinous film of a predetermined shape, same as that shown in FIGS. 7A, 7B, 8A and 8B.

The heating/cooling roller 910 is so structured as to execute press molding in a flat portion of a caterpillar, and the pressing mold in the flat portion is so temperature controlled that the molding temperature is 350° to 380° C. and the releasing temperature is 140° to 150° C. The feeding speed is 1 mm/sec while the pressing pressure is adjusted within a range of 12 to 13 kg/mm$^2$, and the conditions are so set that the total film thickness becomes 50 $\mu$m when the molding is completed.

Thus the independent plural projections 45 and nplural recesses 47*a*, respectively positioned at the centers of the projections 45, are formed by the above-described relief mold in continuous manner along the longitudinal direction of the resinous film 3, as shown in FIGS. 7A, 7B, 8A and 8B. In the present embodiment, the projections 45 and the recesses 47*a* are continuously formed in a single row along the longitudinal direction of the film, but there may be formed plural rows parallel to the longitudinal direction of the film. Each recess 47*a* is to form the orifice 41. The pitch and the external dimension of the projections 45 are same as those in the first embodiment, and the recesses 47*a* have a depth of 40 $\mu$m. A relief mold 907 is provided on the heating/cooling roller 910 in such a manner that such projections 45 and the recesses 47*a* are simultaneously formed on the resinous film 3.

Then the water-repellent layer is formed, by a method similar to that in the first embodiment, on a surface (front surface) of the resinous film 3 opposite to the projections 45. As the water-repellent agent, there was employed CTX-CZ5A supplied by Asahi Glass Co.

After the preparation of the water-repellent layer on the resinous film 3, the orifice plate is prepared by a process similar to that in the second embodiment.

More specifically, as shown in FIG. 8D, the bottom face of each recess 47*a* is irradiated with the laser beam 13 to form a hole penetrating through the resinous film 3, at the bottom face of each recess 47*a* as shown in FIGS. 8E and 8F. Thus there is formed, in the resinous film 3, the orifice 41 with an aperture diameter of 20 $\mu$m at the side opposite to the projection 45.

In case the depth of the recess 47*a* is made large with respect to the thickness of the resinous film 3 thereby reducing the film thickness for opening the orifice 41 by the laser beam 13 to a required dimensional tolerance, the irradiating position of the laser beam 13 need not be aligned with the bottom face of the recess 47*a* but the entire bottom face of the recess 47*a* can be irradiated with the laser beam 13. Thus there can be simplified the process for forming the orifice 41, thereby reducing the manufacturing cost of the liquid discharge head and that of the manufacturing apparatus.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, plural orifices, obtained by forming plural recesses in the respective centers of the plural projections by extrusion molding of the film and irradiating the bottom faces of such recesses with the laser beam, are arranged along the longitudinal direction of the film, so that the orifice plate can be prepared in any size, without limitation in the width of the film. Therefore, as it is unnecessary to adjoin plural orifice plates, there is not observed the defective printing resulting from the crosstalk between the neighboring nozzles induced by the peeling or defective adhesion at the adjoining portion, or the defective printing resulting from the aberration in the landing positions of the liquid droplets induced by the positional aberration between the mutually adjoined two orifice plates. Also there can be obtained an orifice plate with improved thickness distribution of the water-repellent layer.

Sixth Embodiment

In forming the plural projections 45 and the recesses 47*a* respectively positioned at the centers of the projections 45 in the foregoing fifth embodiment on the resinous film 3 composed of polyparaphenylene terephthalamide, the arrangement of such projections 45 and recesses 47*a* may be perpendicular to the longitudinal direction of the film.

According to the method of the present embodiment, the orifices, obtained by forming the plural projection and the plural recesses at the respective centers of the projections on the film and irradiating the bottom faces of the recesses with the laser beam, are arranged in plural units perpendicularly to the longitudinal direction of the film, so that the pitch of the orifices or projections can be made free of error even in case a thin film is elongated or becomes slack in the transportation of the film or in the still state thereof.

Seventh Embodiment

In the foregoing embodiments, the web-shaped resinous film 3 is continuously fed and is made to proceed along the relief mold on the roller periphery (relief mold of the cooling roller 3 shown in FIG. 3 or relief mold 907 of the heating/cooling roller 910 shown in FIG. 11B), whereby the plural projections 45 and the plural orifices 41 or recesses 47*a* are formed by transfer molding on the resinous film 3, which is then wound on a roller.

In such case, the film overlaps in the wound state whereby the projections, the orifices and the adjoining faces around the projection for adhesion with the head main body may be damaged.

In consideration of such situation, it is preferable to form a recess on a surface of the resinous film 3 and to form the projection 45 on the bottom face of such recess, as shown in FIGS. 4B, 6B, 7B and 10B. In such case, the projection 45 is formed into a height that is equal to or lower than the surface of the resinous film 3 contacting the winding roller. Stated differently, the height of the projection 45 is made same as or lower than the depth of the recess in which the projection 45 is provided.

Figure 12A:
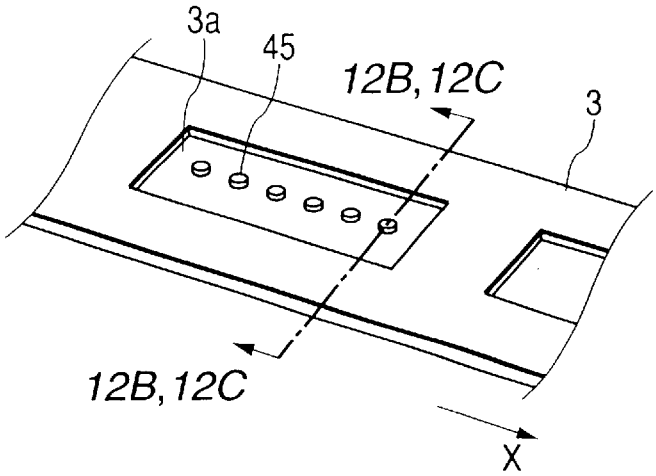
FIGS. 12A, 12B and 12C are views showing the configuration of a sheet-shaped orifice plate to be employed in the producing method for the liquid discharge head of the present invention.
Figure 12B:
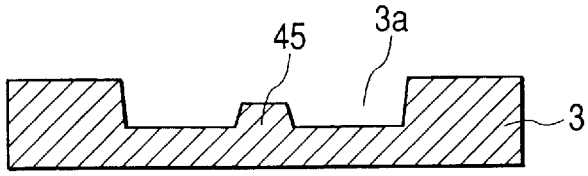
Figure 12C:
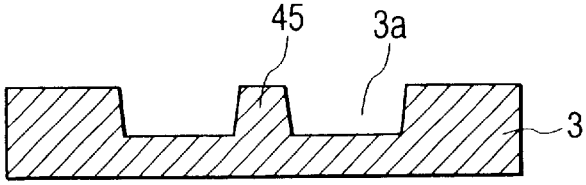
Figure 13A:
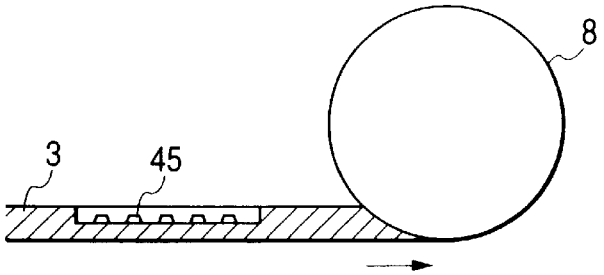
FIGS. 13A and 13B are views showing the effect of a seventh embodiment of the present invention.
Figure 13B:
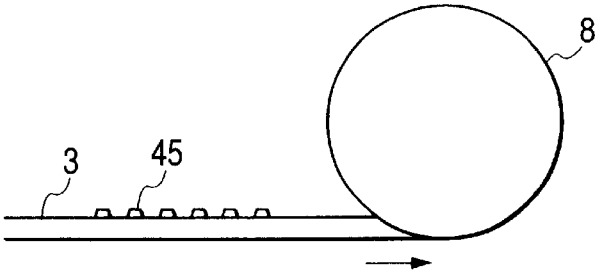

An example of such configuration is shown in FIGS. 12A to 12C. FIG. 12A is a schematic perspective view of an example in which the projections 45 are arranged along the longitudinal direction of the film, while FIG. 12B is a cross-sectional view along a line 12B—12B in FIG. 12A, showing a case where the height of the projection 45 is lower than the principal surface of the film (lower than the depth of the recess 3*a*), and FIG. 12C is a cross-sectional view along a line 12C—12C in FIG. 12A, showing a case where the height of the projection 45 is same as the principal surface of the film (same as the depth of the recess 3*a*). Also FIG. 13A is a schematic view showing the state of rolling the film of the present embodiment, and FIG. 13B is a schematic view showing the state of rolling a film in which the projections 45 protrude from the principal surface of the film. If the projections 45 protrude from the principal surface of the film as shown in FIG. 13B, the projections 45 may be pressed and damaged by the superposing of the film in the rolled state. However, according to the present embodiment, such drawback can be avoided since the projections 45 do not protrude from the overlapping surface of the film so that satisfactory orifice plate can be prepared.

Also in the above-described method, even in an orifice plate lacking the projection 45 around the orifice 41, the orifice and the forming face therefor can be protected since no contact is caused in the rolling operation around the orifice hole which is essential for the discharge characteristics.

In the sheet transporting system as shown in FIG. 3, it is preferable to pay consideration to the configuration of the transporting rollers coming into contact with the projection-bearing surface of the sheet (for example the transporting rollers a, b in FIG. 3), in such a manner that the projections of the orifice plate are not abraded by or do not engage with the periphery of such transporting roller. For this purpose, such contacting transport roller may be formed as a pair of rollers contacting a sheet portion outside the area bearing the projections.

Otherwise, such contacting transport roller may have a contact length with the sheet, larger than the length of the recess for protecting the projection on the orifice plate, in the longitudinal direction of the film.

In case of using a crowned roller (having a central portion curved outwardly) in order to avoid inclination of the web-shaped orifice plate in the course of transportation, such crowned roller is preferably so positioned as to be in contact with the surface of the sheet opposite to the surface bearing the above-mentioned projections. On the other hand, in case of using an inversely crowned roller (having a central portion curved inwardly), it may be so positioned as to come into contact with the sheet surface bearing the projections, but preferably so as not to contact the projections in consideration of the curvature of such roller.

Eighth Embodiment

FIGS. 14A, 14B and FIGS. 15A to 15F are views showing the method for producing the liquid discharge head of an eighth embodiment of the present invention. The method of the present embodiment is to prepare a liquid discharge head similar in configuration and shape to that of the first embodiment, and is principally different from the method of the first embodiment in that the orifice is prepared by laser working. Also it is different from the method of the third embodiment in that the orifice is formed by pressing with the relief mold, without forming the recess on the resinous film. In the following there will be principally explained the differences from the first and third embodiments.

Figure 14A:
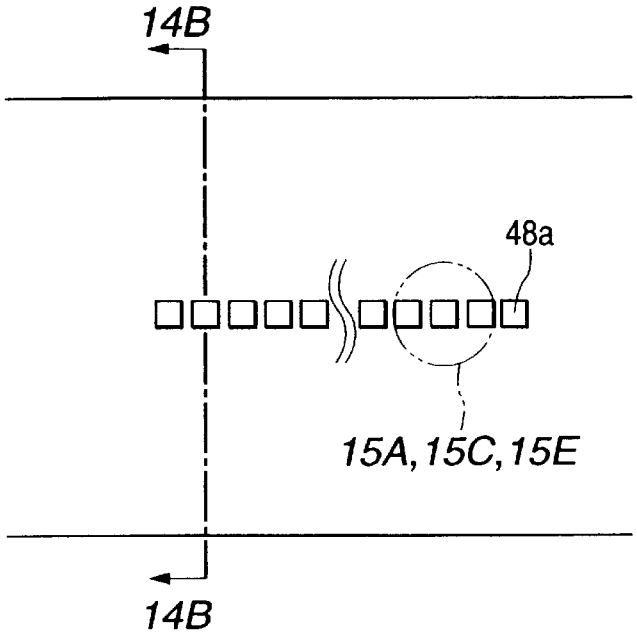
FIGS. 14A and 14B are views showing the producing method for the liquid discharge head, in an eighth embodiment of the present invention.
Figure 14B:
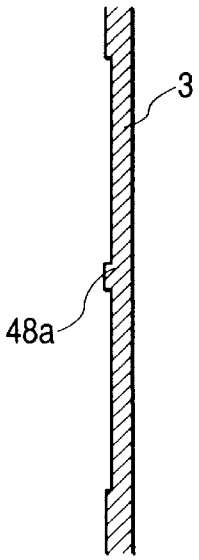
Figure 15A:
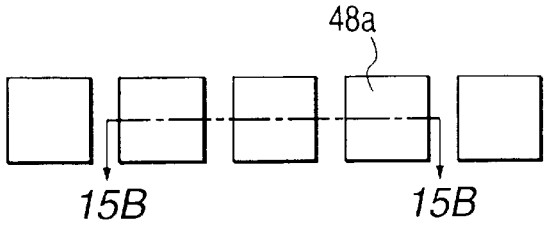
FIGS. 15A, 15B, 15C, 15D, 15E and 15F are views showing the producing method for the liquid discharge head, in the eighth embodiment of the present invention.
Figure 15B:
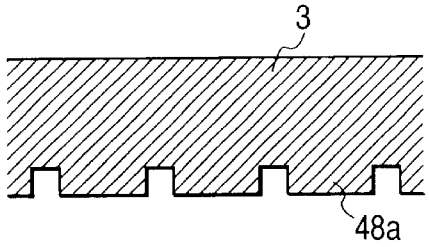

Also in the producing method of the present embodiment, a resinous film for preparing the orifice plate is formed by the manufacturing line of the first embodiment shown in FIG. 3. There is however employed a cooling roller 5 provided with a relief mold of another predetermined shape, instead of the relief mold 4 employed in the first embodiment. FIG. 14A is a plan view of the resinous film molded into a predetermined shape, by pressing polysulfone resin extruded from the die 3 of the extruder 1 with the above-described relief mold provided on the cooling roller 5, and FIG. 14B is a cross-sectional view along a line 14B—14B in FIG. 14A. FIG. 15A is a magnified plan view of a portion 15A of the resinous film shown in FIG. 14A, and FIG. 15B is a cross-sectional view along a line 15B—15B in FIG. 15A.

At first a resinous film 3 is formed by extruding polysulfone resin from the die 2 with a thickness of 50 $\mu$m, with the extruding conditions (A) same as those in the first embodiment. The resinous film 3 is then cooled, simultaneous with pressing by the cooling roller 5 of 15° C. surfacially provided with the above-mentioned relief mold and the nip roller 6. Thus, by the relief mold provided on the cooling roller 5, independent plural projections 48*a* for forming the projections 45 are formed in continuous manner along the extruding direction of the resinous film 3 as shown in FIGS. 14A, 14B, 15A and 15B. The pitch and the external dimension of the projections 48*a* are same as those of the projections 45 to be finally formed on the resinous film 3. The relief mold provided on the cooling roller 5 is so prepared that such projection 48*a* are formed on the resinous film 3.

Then the water-repellent layer is formed, by a method similar to that in the first embodiment, on a surface (front surface) of the resinous film 3 opposite to the projections 48*a*. As the water-repellent agent, there was employed CTX-CZ5A supplied by Asahi Glass Co.

Figure 15C:
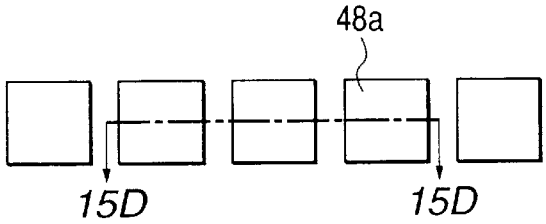

In the following there will be explained, with reference to FIGS. 15A to 15F, the process for preparing the orifice plate after the formation of the water-repellent layer on the resinous film 3. FIGS. 15C and 15E are magnified plan views of portions 15C, 15E of the resinous film shown in FIG. 14A, while FIG. 15D is a cross-sectional view along a line 15D—15D in FIG. 15C, and FIG. 15F is a cross-sectional view along a line 15F—15F in FIG. 15E.

Figure 15D:
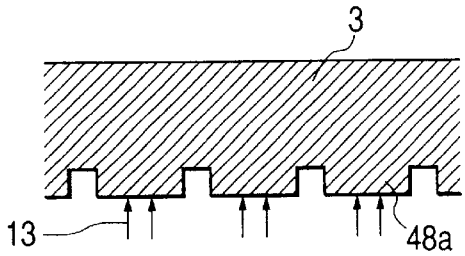
Figure 15E:
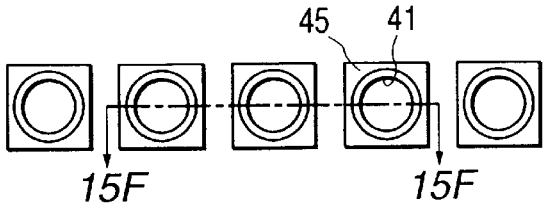
Figure 15F:
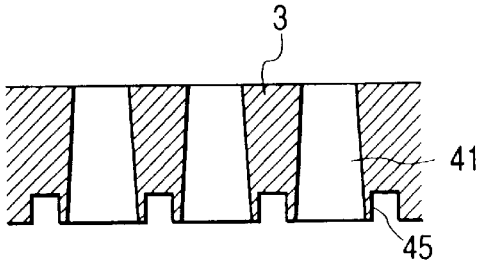

As shown in FIG. 15D, the central portion of the end face each projection 48*a* is irradiated with a laser beam 13 to form a hole penetrating through the resinous film 3, namely the orifice 41, at the center of each projection 48*a* as shown in FIGS. 15E and 15F. Thus there is formed, in the resinous film 3, an orifice 41 with an aperture diameter of 20 $\mu$m at a side opposite to the projection 45. The orifice 41 is formed in the resinous film 3 by a method similar to that in the third embodiment, with the laser working apparatus of the second embodiment shown in FIG. 9.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, as in the first embodiment, each orifice plate 40 is not prepared in divided manner but in an integral structure, so that even the orifice plate 40 with a large number of orifices 41 can be obtained without any joint therein and with satisfactory dimensional precision of the orifices 41 and the projections 45. Thus there can be avoided the defect that the projections 45 of the orifice plate 40 cannot be fitted with the liquid paths 61 of the head main body 46. Also the recording with thus prepared liquid discharge head was free from defects such as deviation of the flying liquid droplets or non-uniformity in the recorded image, resulting from the defects in the joint in the orifice plate, encountered when the orifice plate is prepared in divided manner and provided satisfactory recording quality.

Nineth Embodiment

FIGS. 16A, 16B and FIGS. 17A to 17F are views showing the method for producing the liquid discharge head of a nineth embodiment of the present invention. The method of the present embodiment is to prepare a liquid discharge head similar in configuration and shape to that of the first embodiment, and is principally different from the method of the first embodiment in that the projection around the orifice is prepared by laser working. In the following there will be principally explained the differences from the first embodiment.

Figure 16A:
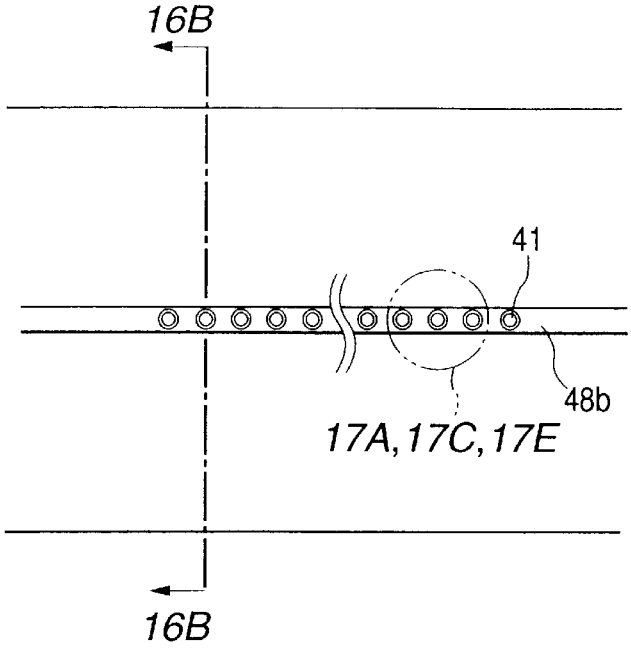
FIGS. 16A and 16B and FIGS. 17A, 17B, 17C, 17D, 17E and 17F are views showing the producing method for the liquid discharge head, in a nineth embodiment of the present invention.
Figure 16B:
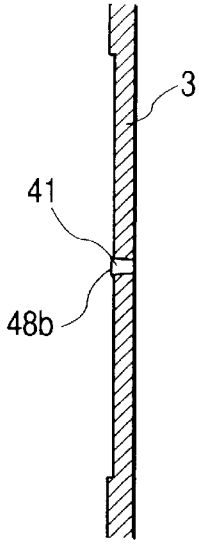
Figure 17A:
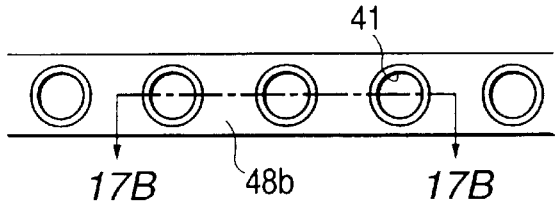
Figure 17B:
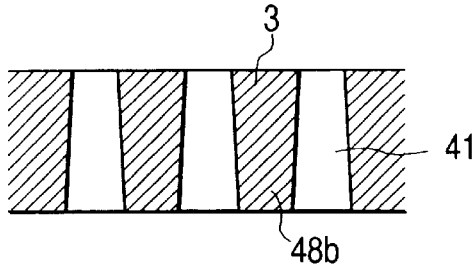

Also in the producing method of the present embodiment, a resinous film for preparing the orifice plate is formed by the manufacturing line of the first embodiment shown in FIG. 3. There is however employed a cooling roller 5 provided with a relief mold of another predetermined shape, instead of the relief mold 4 employed in the first embodiment. FIG. 16A is a plan view of the resinous film molded into a predetermined shape, by pressing polysulfone resin extruded from the die 2 of the extruder 1 with the above-described relief mold provided on the cooling roller 5, and FIG. 16B is a cross-sectional view along a line 16B—16B in FIG. 16A. FIG. 17A is a magnified plan view of a portion 17A of the resinous film shown in FIG. 16A, and FIG. 17B is a cross-sectional view along a line 17B—17B in FIG. 17A.

At first a resinous film 3 is formed by extruding polysulfone resin from the die 2 with a thickness of 50 μm, with the extruding conditions (A) same as those in the first embodiment. The resinous film 3 is then cooled, simultaneous with pressing by the cooling roller 5 of 15° C. surfacially provided with the above-mentioned relief mold and the nip roller 6. Thus, by the relief mold provided on the cooling roller 5, a projection 48*b* continuous in the extruding direction of the film for forming the projections 45 and plural orifices 41 arranged in the projection 48*b* are formed on the resinous film 3 as shown in FIGS. 16A, 16B, 17A and 17B. The projection 48*b* has a width of 30 μm and a height of 10 μm. The relief mold provided on the cooling roller 5 is so prepared that such projection 48*b* and orifices 41 are formed on the resinous film 3.

Then the water-repellent layer is formed, by a method similar to that in the first embodiment, on a surface (front surface) of the resinous film 3 opposite to the projections 48*a*. As the water-repellent agent, there was employed CTX-CZ5A supplied by Asahi Glass Co.

Figure 17C:
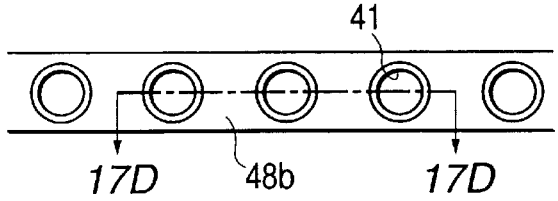

In the following there will be explained, with reference to FIGS. 17A to 17F, the process for preparing the orifice plate after the formation of the water-repellent layer on the resinous film 3. FIGS. 17C and 17E are magnified plan views of portions 17C, 17E of the resinous film shown in FIG. 16A, while FIG. 17D is a cross-sectional view along a line 17D—17D in FIG. 17C, and FIG. 17F is a cross-sectional view along a line 17F—17F in FIG. 17E.

Figure 17D:
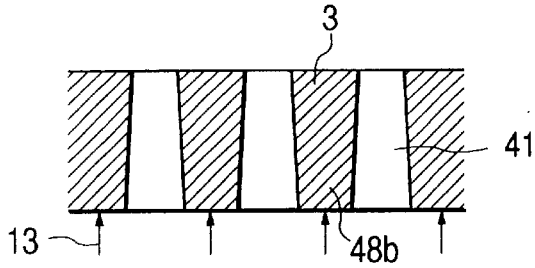
Figure 17E:
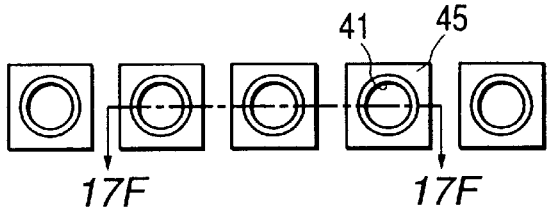
Figure 17F:
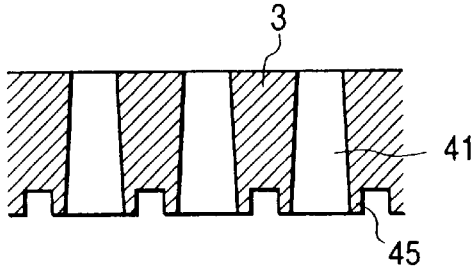

As shown in FIG. 17D, the unnecessary portions of the projection 48*b* are eliminated by irradiating the portions excluding the portions corresponding to the orifices 41 and the projections 45 on the end face of the projection 48*b* with the laser beam 13, thereby forming independent plural projections 45 respectively corresponding to the orifices 41. The projections 45 are formed with the laser working apparatus of the third embodiment shown in FIG. 9, but the mask 12 in the third embodiment is replaced by another mask with a predetermined pattern for forming the projections 45.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, as in the first embodiment, each orifice plate 40 is not prepared in divided manner but in an integral structure, so that even the orifice plate 40 with a large number of orifices 41 can be obtained without any joint therein and with satisfactory dimensional precision of the orifices 41 and the projections 45. Thus there can be avoided the defect that the projections 45 of the orifice plate 40 cannot be fitted with the liquid paths 61 of the head main body 46. Also the recording with thus prepared liquid discharge head was free from defects such as deviation of the flying liquid droplets or non-uniformity in the recorded image, resulting from the defects in the joint in the orifice plate, encountered when the orifice plate is prepared in divided manner and provided satisfactory recording quality.

Tenth Embodiment

FIGS. 18A, 18B, FIG. 19A to 19F and FIGS. 20A to 20D are views showing the method for producing the liquid discharge head of a tenth embodiment of the present invention. The method of the present embodiment is to prepare a liquid discharge head similar in configuration and shape to that of the first embodiment.

Figure 18A:
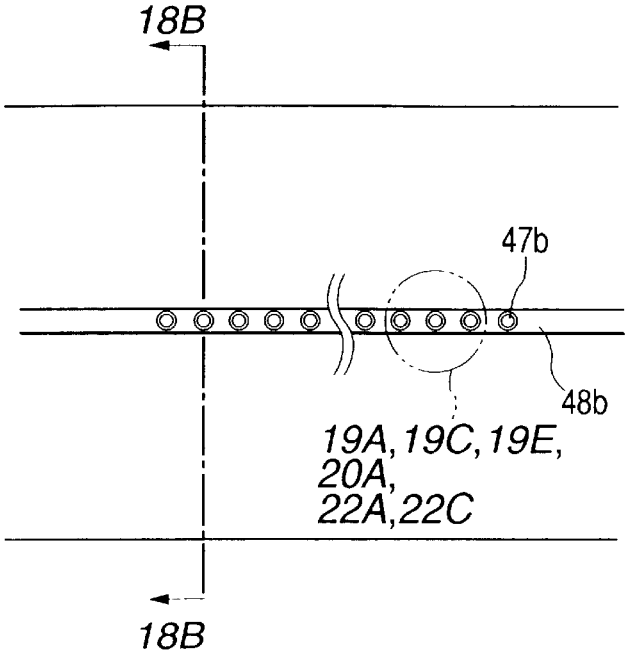
FIGS. 18A and 18B, FIGS. 19A, 19B, 19C, 19D, 19E and 19F and FIGS. 20A, 20B, 20C and 20D are views showing the producing method for the liquid discharge head, in a tenth embodiment of the present invention.
Figure 18B:
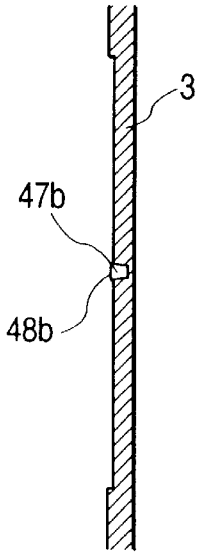
Figure 19A:
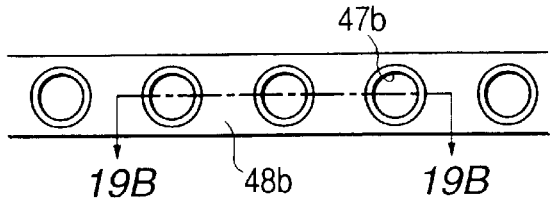
Figure 19B:
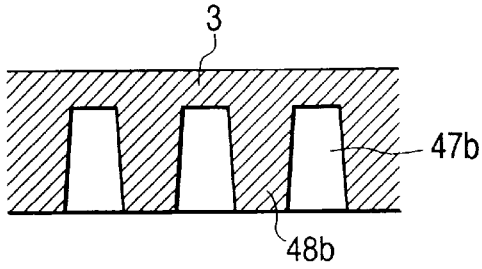

Also in the producing method of the present embodiment, a resinous film for preparing the orifice plate is formed by the manufacturing line of the first embodiment shown in FIG. 3. There is however employed a cooling roller 5 provided with a relief mold of another predetermined shape, instead of the relief mold 4 employed in the first embodiment. There is however employed a cooling roller 5 provided with a relief mold of another predetermined shape, instead of the relief mold 4 employed in the first embodiment. FIG. 18A is a plan view of the resinous film molded into a predetermined shape, by pressing polysulfone resin extruded from the die 2 of the extruder 1 with the above-described relief mold provided on the cooling roller 5, and FIG. 18B is a cross-sectional view along a line 18B—18B in FIG. 18A. FIG. 19A is a magnified plan view of a portion 19A of the resinous film shown in FIG. 18A, and FIG. 19B is a cross-sectional view along a line 19B—19B in FIG. 19A.

At first a resinous film 3 is formed by extruding polysulfone resin from the die 2 with a thickness of 50 μm, with the extruding conditions (A) same as those in the first embodiment. The resinous film 3 is then cooled, simultaneous with pressing by the cooling roller 5 of 15° C. surfacially provided with the above-mentioned relief mold and the nip roller 6. Thus, by the relief mold provided on the cooling roller 5, a projection 48*b* continuous in the extruding direction of the film for forming the projections 45 and plural recesses 47*b* arranged in the projection 48*b* are formed on the resinous film 3 as shown in FIGS. 18A, 18B, 19A and 19B. Each recess 47*a* is form the orifice 41, and the plural recesses 47*b* are mutually independent. The projection 48*b* has a width of 30 μm and a height of 10 μm. The relief mold provided on the cooling roller 5 is so prepared that such projection 48*b* and recesses 47*b* are formed on the resinous film 3.

Then the water-repellent layer is formed, by a method similar to that in the first embodiment, on a surface (front surface) of the resinous film 3 opposite to the projection 48*b*. As the water-repellent agent, there was employed CTX-CZ5A supplied by Asahi Glass Co.

Figure 19C:
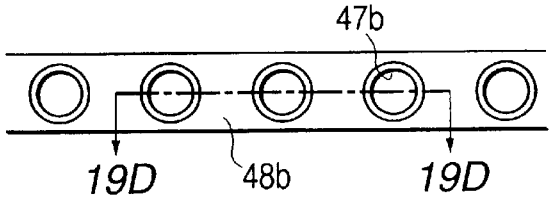

In the following there will be explained, with reference to FIGS. 19A to 19F and FIGS. 20A to 20D, the process for preparing the orifice plate after the formation of the water-repellent layer on the resinous film 3. FIGS. 19C, 19E, 20A and 20C are magnified plan views of a portion 20A of the resinous film shown in FIG. 18A, while FIG. 19D is a cross-sectional view along a line 19D—19D in FIG. 19C, FIG. 19F is a cross-sectional view along a line 19F—19F in FIG. 19E, FIG. 20B is a cross-sectional view along a line 20B—20B in FIG. 20A, and FIG. 20D is a cross-sectional view along a line 20D—20D in FIG. 20C.

Figure 19D:
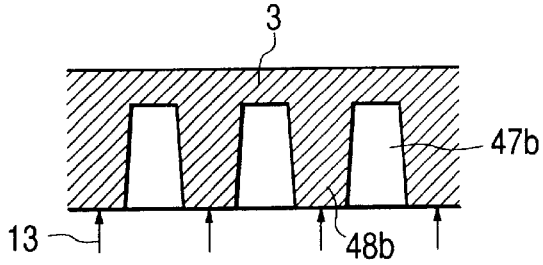
Figure 19E:
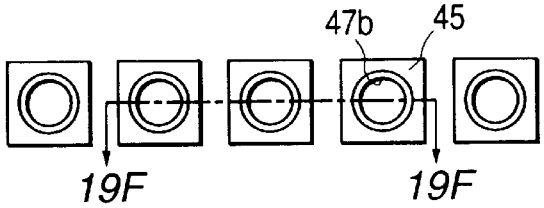
Figure 19F:
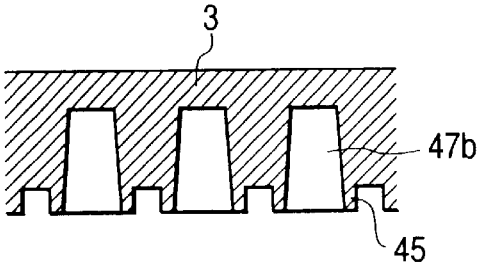
Figure 20A:
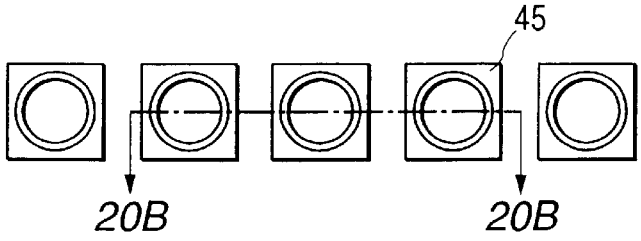

As shown in FIG. 19D, the unnecessary portions of the projection 48*b* are eliminated by irradiating the portions excluding the portions corresponding to the recesses 47*b* and the projections 45 on the end face of the projection 48*b* with the laser beam 13, thereby forming independent plural projections 45 respectively corresponding to the recesses 47*b*.

Figure 20B:
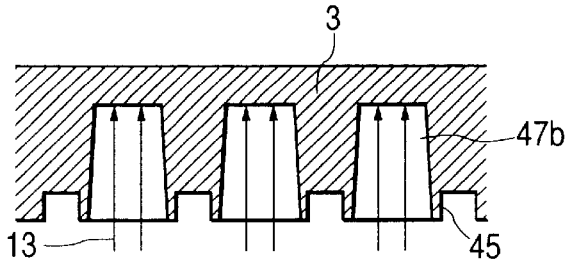
Figure 20C:
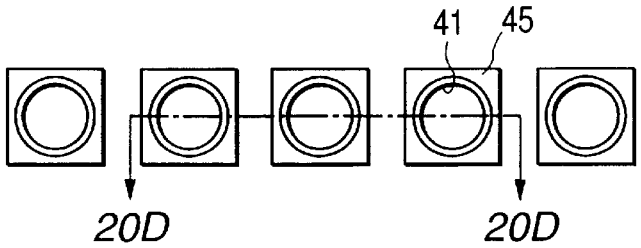
Figure 20D:
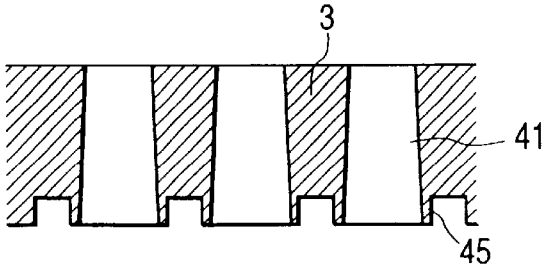

Then, as shown in FIG. 20B, the bottom face of each recess 47*b* is irradiated with the laser beam 13 to form a hole penetrating through the resinous film 3 as shown in FIGS. 20C and 20D, whereby an orifice 41 with an aperture diameter of 20 μm at a side opposite to the projection 45 is formed on the resinous film 3.

Also in the present embodiment, the orifices 41 and the projections 45 are formed in the resinous film 3 with the laser working apparatus of the third embodiment shown in FIG. 9. In forming the projections 45 by the laser working, the mask 12 in the third embodiment is replaced by another mask with a predetermined pattern for forming the projections 45 as in the nineth embodiment, and, in forming the orifices 41, a mask 12 similar to that in the third embodiment is employed for opening the bottom face of the recess 47*b*.

In case the depth of the recess 47*b* is made large as in the third embodiment with respect to the thickness of the resinous film 3 thereby reducing the film thickness for opening the orifice 41 by the laser beam 13 to a required dimensional tolerance, the irradiating position of the laser beam 13 need not be aligned with the bottom face of the recess 47*b* but the entire bottom face of the recess 47*a* can be irradiated with the laser beam 13. Thus there can be simplified the process for forming the orifice 41, thereby reducing the manufacturing cost of the liquid discharge head and that of the manufacturing apparatus.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, as in the first embodiment, each orifice plate 40 is not prepared in divided manner but in an integral structure, so that even the orifice plate 40 with a large number of orifices 41 can be obtained without any joint therein and with satisfactory dimensional precision of the orifices 41 and the projections 45. Thus there can be avoided the defect that the projections 45 of the orifice plate 40 cannot be fitted with the liquid paths 61 of the head main body 46. Also the recording with thus prepared liquid discharge head was free from defects such as deviation of the flying liquid droplets or non-uniformity in the recorded image, resulting from the defects in the joint in the orifice plate, encountered when the orifice plate is prepared in divided manner and provided satisfactory recording quality.

Eleventh Embodiment

FIGS. 21A to 21F and FIGS. 22A to 22D are views showing the method for producing the liquid discharge head of an eleventh embodiment of the present invention. The method of the present embodiment is to prepare a liquid discharge head similar in configuration and shape to that of the first embodiment. In the method of the present embodiment, the step for forming the orifices by laser working and the step for forming the projections by laser working are exchanged in order, in comparison with the method of the tenth embodiment.

Also in the producing method of the present embodiment, a resinous film 3 with the projection 48*b* and the recesses 47*b* as in the tenth embodiment is formed by the manufacturing line of the first embodiment shown in FIG. 3.

Then the water-repellent layer is formed, by a method similar to that in the first embodiment, on a surface (front surface) of the resinous film 3 opposite to the projection 48*b*. As the water-repellent agent, there was employed CTX-CZ5A supplied by Asahi Glass Co.

Figure 21A:
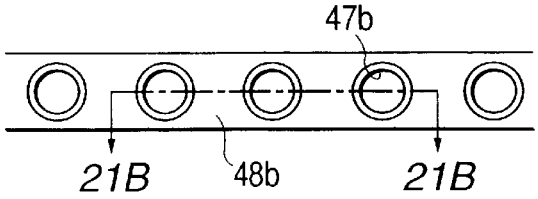
FIGS. 21A, 21B, 21C, 21D, 21E and 21F and FIGS. 22A, 22B, 22C and 22D are views showing the producing method for the liquid discharge head, in an eleventh embodiment of the present invention.

In the following there will be explained, with reference to FIGS. 21A to 21F and FIGS. 22A to 22D, the process for preparing the orifice plate after the formation of the water-repellent layer on the resinous film 3. FIGS. 21A, 21C, 21E, 22A and 22C are magnified plan views of portions 22A, 22C of the resinous film shown in FIG. 18A, while FIG. 21B is a cross-sectional view along a line 21B—21B in FIG. 21A, FIG. 21D is a cross-sectional view along a line 21D—21D in FIG. 21C, FIG. 21F is a cross-sectional view along a line 21F—21F in FIG. 21E, FIG. 22B is a cross-sectional view along a line 22B—22B in FIG. 22A and FIG. 22D is a cross-sectional view along a line 22D—22D in FIG. 22C.

Figure 21B:
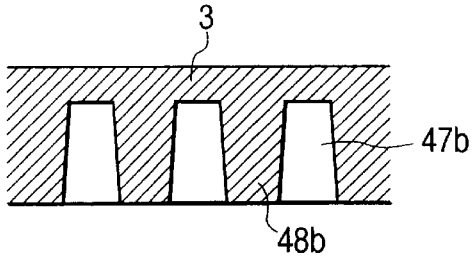
Figure 21C:
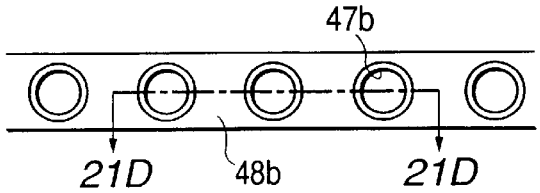
Figure 22A:
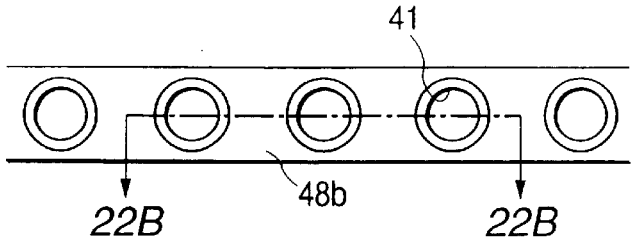

As shown in FIGS. 21A and 21B, the resinous film 3 is provided with the projection 48*b* and the recesses 47*b* explained in the tenth embodiment, by pressing with the relief mold provided on the cooling roller 5.

Figure 21D:
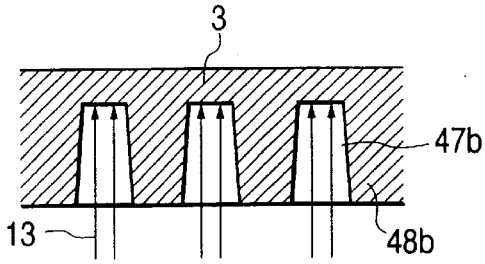
Figure 21E:
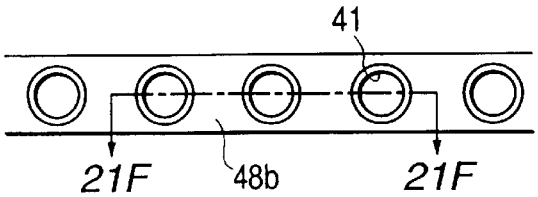
Figure 21F:
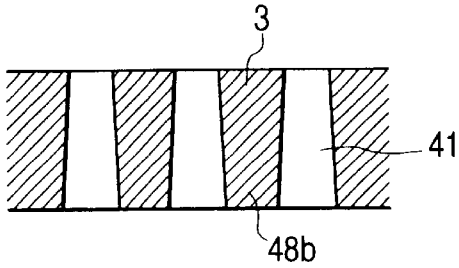

Then, as shown in FIG. 21D, the bottom face of each recess 47*b* is irradiated with the laser beam 13 to form a hole penetrating through the resinous film 3 as shown in FIGS. 21E and 21F, whereby an orifice 41 with an aperture diameter of 20 μm at a side opposite to the projection 45 is formed on the resinous film 3.

Figure 22B:
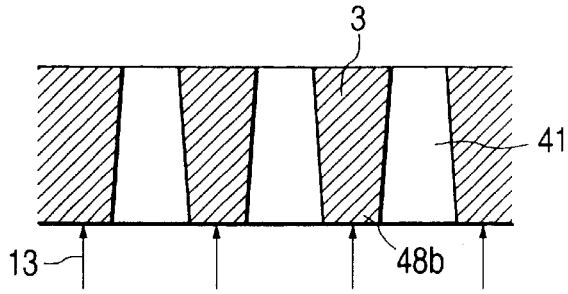
Figure 22C:
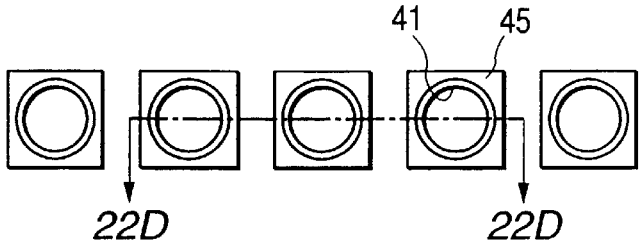
Figure 22D:
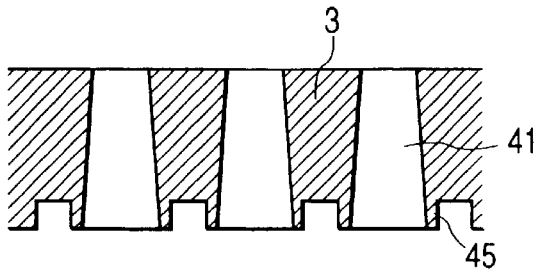

Then, as shown in FIG. 22B, the unnecessary portions of the projection 48*b* are eliminated by irradiating the portions excluding the portions corresponding to the orifices 41 and the projections 45 on the end face of the projection 48*b* with the laser beam 13, thereby forming independent plural projections 45 respectively corresponding to the orifices 41 as shown in FIGS. 22C and 22D. Also in the present embodiment, the projections 45 and the orifices 41 are formed with the laser working apparatus of the third embodiment shown in FIG. 9.

Also in the producing method of the present embodiment, in case the depth of the recess 47*b* is made large as in the third embodiment with respect to the thickness of the resinous film 3 thereby reducing the film thickness for opening the orifice 41 by the laser beam 13 to a required dimensional tolerance, the irradiating position of the laser beam 13 need not be aligned with the bottom face of the recess 47*b* but the entire bottom face of the recess 47*a* can be irradiated with the laser beam 13. Thus there can be simplified the process for forming the orifice 41, thereby reducing the manufacturing cost of the liquid discharge head and that of the manufacturing apparatus.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, as in the first embodiment, each orifice plate 40 is not prepared in divided manner but in an integral structure, so that even the orifice plate 40 with a large number of orifices 41 can be obtained without any joint therein and with satisfactory dimensional precision of the orifices 41 and the projections 45. Thus there can be avoided the defect that the projections 45 of the orifice plate 40 cannot be fitted with the liquid paths 61 of the head main body 46. Also the recording with thus prepared liquid discharge head was free from defects such as deviation of the flying liquid droplets or non-uniformity in the recorded image, resulting from the defects in the joint in the orifice plate, encountered when the orifice plate is prepared in divided manner and provided satisfactory recording quality.

Twelfth Embodiment

FIGS. 23A, 23B, FIGS. 24A to 24F and FIG. 25A to 25D are views showing the method for producing the liquid discharge head of a twelfth embodiment of the present invention. The method of the present embodiment is to prepare a liquid discharge head similar in configuration and shape to that of the first embodiment.

Figure 23A:
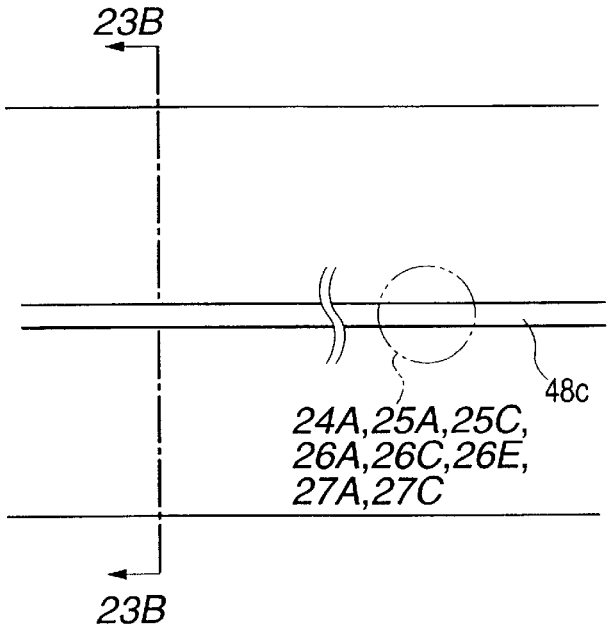
FIGS. 23A, 23B and FIGS. 24A, 24B, 24C, 24D, 24E and 24F are views showing the producing method for the liquid discharge head, in a twelfth embodiment of the present invention.
Figure 23B:
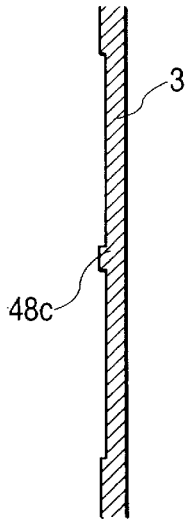
Figure 24A:
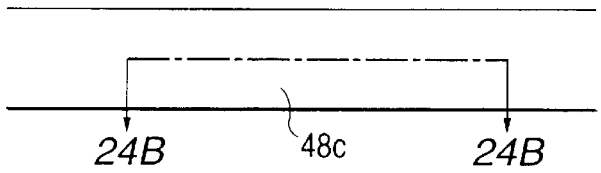
Figure 24B:
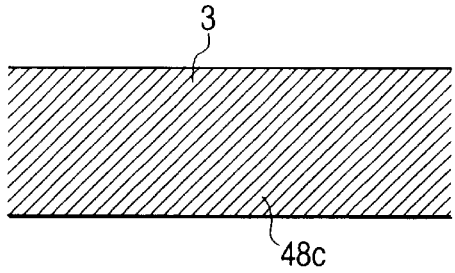

Also in the producing method of the present embodiment, a resinous film for preparing the orifice plate is formed by the manufacturing line of the first embodiment shown in FIG. 3. There is however employed a cooling roller 5 provided with a relief mold of another predetermined shape, instead of the relief mold 4 employed in the first embodiment. FIG. 23A is a plan view of the resinous film molded into a predetermined shape, by pressing polysulfone resin extruded from the die 2 of the extruder 1 with the above-described relief mold provided on the cooling roller 5, and FIG. 23B is a cross-sectional view along a line 23B—23B in FIG. 23A. FIG. 24A is a magnified plan view of a portion 24A of the resinous film shown in FIG. 23A, and FIG. 24B is a cross-sectional view along a line 24B—24B in FIG. 24A.

At first a resinous film 3 is formed by extruding polysulfone resin from the die 2 with a thickness of 50 $\mu$m, with the extruding conditions (A) same as those in the first embodiment. The resinous film 3 is then cooled, simultaneous with pressing by the cooling roller 5 of 15° C. surfacially provided with the above-mentioned relief mold and the nip roller 6. Thus, by the relief mold provided on the cooling roller 5, a projection 48*c* continuous in the extruding direction of the film for forming the plural projections 45 as shown in FIGS. 1 and 2 is formed on the resinous film 3 as shown in FIGS. 23A, 23B, 24A and 24B. The projection 48*b* is to form the projections 45 has a width of 30 $\mu$m and a height of 10 $\mu$m. The relief mold provided on the cooling roller 5 is so prepared that such projection 48*c* is formed on the resinous film 3.

Then the water-repellent layer is formed, by a method similar to that in the first embodiment, on a surface (front surface) of the resinous film 3 opposite to the projections 48*a*. As the water-repellent agent, there was employed CTX-CZ5A supplied by Asahi Glass Co.

Figure 24C:
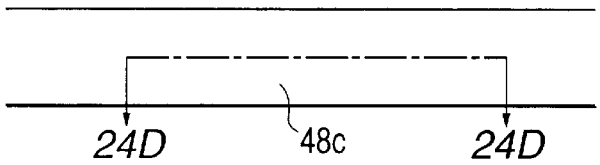

In the following there will be explained, with reference to FIGS. 24A to 24F and FIGS. 25A to 25D, the process for preparing the orifice plate after the formation of the water-repellent layer on the resinous film 3. FIGS. 24C, 24E, 25A and 25C are magnified plan views of portions 25A, 25C of the resinous film shown in FIG. 23A, while FIG. 24D is a cross-sectional view along a line 24D—24D in FIG. 24C, FIG. 24F is a cross-sectional view along a line 24F—24F in FIG. 24E, FIG. 25B is a cross-sectional view along a line 25B—25B in FIG. 25A and FIG. 25D is a cross-sectional view along a line 25D—25D in FIG. 25C.

Figure 24D:
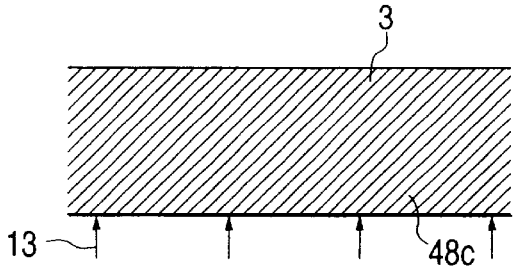
Figure 24E:
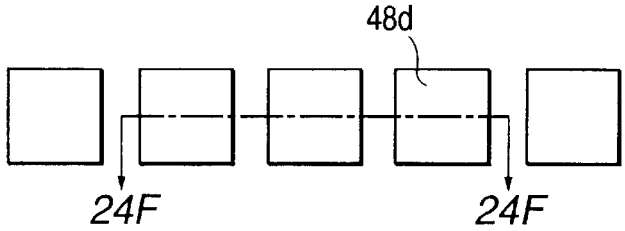
Figure 24F:
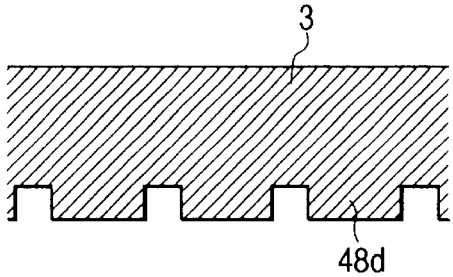
Figure 25A:
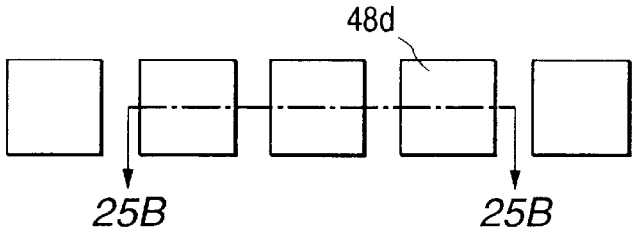
FIGS. 25A, 25B, 25C and 25D and FIGS. 26A, 26B, 26C, 26D, 26E and 26F are views showing the producing method for the liquid discharge head, in a thirteenth embodiment of the present invention.

As shown in FIG. 24D, the unnecessary portions of the projection 48*c* are eliminated by irradiating the portions excluding the portions corresponding to the orifices 41 and the projections 45 on the end face of the projection 48*c* with the laser beam 13, thereby forming independent plural projections 48*d* as shown in FIGS. 24E and 24F. Each projection 48*d* is similar in external shape to the projection 45, and has a dimension of 30×30 $\mu$m and a height of 10 $\mu$m.

Figure 25B:
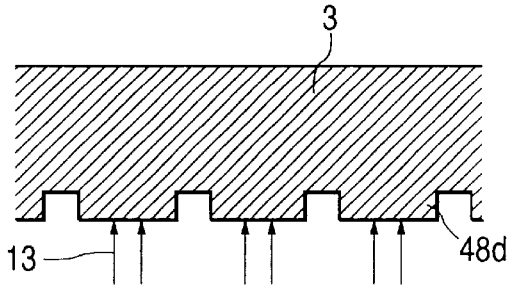
Figure 25C:
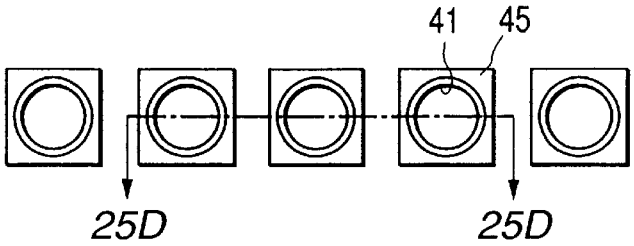
Figure 25D:
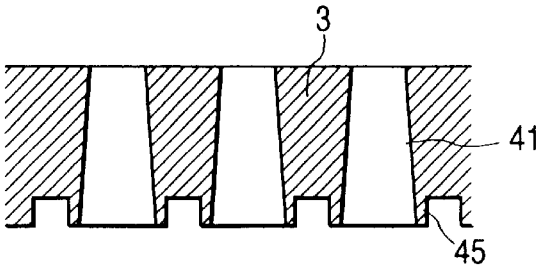

Then, as shown in FIG. 25B, the central part of the end face of each projection 48*d* is irradiated with the laser beam 13 to form a hole penetrating through the resinous film 3 in the center of each projection 48*d* as shown in FIGS. 25C and 25D, whereby an orifice 41 with an aperture diameter of 25 $\mu$m at the side of the projection 45 and an aperture diameter of 20 $\mu$m at a side opposite to the projection 45 is formed on the resinous film 3.

Also in the present embodiment, the projections 48*d*, the projections 45 and the orifices 41 are formed with the laser working apparatus of the third embodiment shown in FIG. 9. In forming the projections 48*d* by the laser working, the mask 12 in the second embodiment is replaced by another mask with a predetermined pattern for forming the projections 45 as in the nineth embodiment, and, in forming the orifices 41, a mask 12 similar to that in the second embodiment is employed for opening the central part of the projection 48*d*.

Then, the resinous film 3 wound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, as in the first embodiment, each orifice plate 40 is not prepared in divided manner but in an integral structure, so that even the orifice plate 40 with a large number of orifices 41 can be obtained without any joint therein and with satisfactory dimensional precision of the orifices 41 and the projections 45. Thus there can be avoided the defect that the projections 45 of the orifice plate 40 cannot be fitted with the liquid paths 61 of the head main body 46. Also the recording with thus prepared liquid discharge head was free from defects such as deviation of the flying liquid droplets or non-uniformity in the recorded image, resulting from the defects in the joint in the orifice plate, encountered when the orifice plate is prepared in divided manner and provided satisfactory recording quality.

Thirteenth Embodiment

FIGS. 26A to 26F and FIGS. 27A to 27D are views showing the method for producing the liquid discharge head of a thirteenth embodiment of the present invention. The method of the present embodiment is to prepare a liquid discharge head similar in configuration and shape to that of the first embodiment. The producing method of the present embodiment is different from that of the twelfth embodiment in that the orifice is formed prior to the formation of the external shape of the projection to be fitted in the liquid path.

Also in the producing method of the present embodiment, a resinous film 3 bearing the projection 48*c* of the twelfth embodiment shown in FIGS. 24A to 24F is formed by the manufacturing line of the first embodiment shown in FIG. 3.

Then the water-repellent layer is formed, by a method similar to that in the first embodiment, on a surface (front surface) of the resinous film 3 opposite to the projections 48*c*. As the water-repellent agent, there was employed CTX-CZ5A supplied by Asahi Glass Co.

Figure 26A:
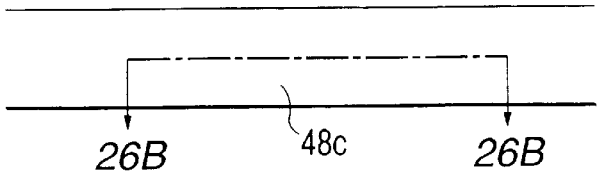

In the following there will be explained, with reference to FIGS. 26A to 26F and FIGS. 27A to 27D, the process for preparing the orifice plate after the formation of the water-repellent layer on the resinous film 3. FIGS. 26A, 26C, 26E, 27A and 27C are magnified plan views of portions 26A, 26C, 26E, 27A and 27C of the resinous film shown in FIG. 23A, while FIG. 26B is a cross-sectional view along a line 26B—26B in FIG. 26A, FIG. 26D is a cross-sectional view along a line 26D—26D in FIG. 26C, FIG. 26F is a cross-sectional view along a line 26F—26F in FIG. 26E, FIG. 27B is a cross-sectional view along a line 27B—27B in FIG. 27A and FIG. 27D is a cross-sectional view along a line 27D—27D in FIG. 27C.

Figure 26B:
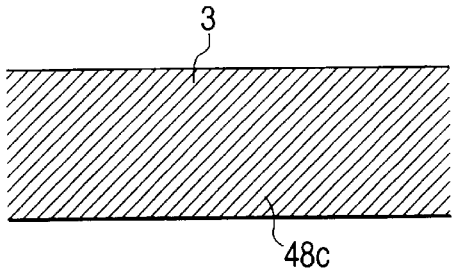
Figure 26C:
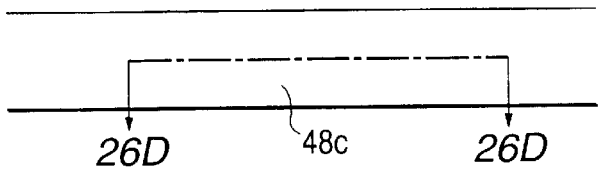
Figure 27A:
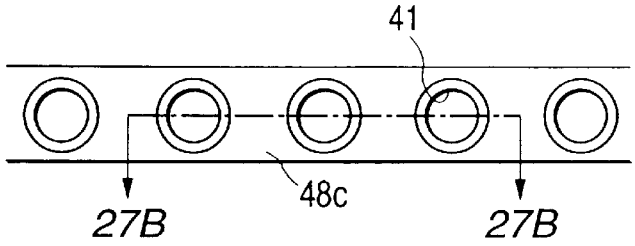
FIGS. 27A, 27B, 27C, and 27D are views showing the producing method for the liquid discharge head, in a fourteenth embodiment of the present invention.

As shown in FIGS. 26A and 26B, the resinous film 3 is provided with the projection 48*c* explained in the twelfth embodiment, by the pressing with the relief mold provided on the cooling roller 5.

Figure 26D:
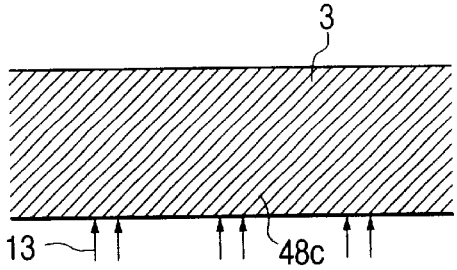
Figure 26E:
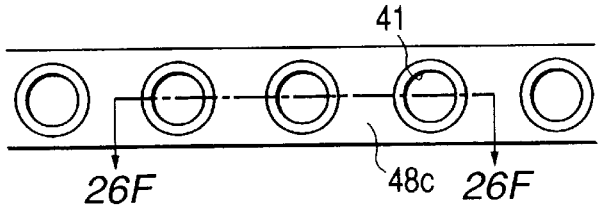
Figure 26F:
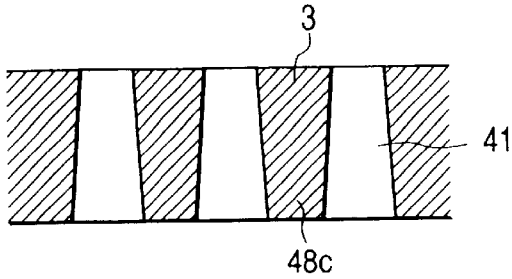

Then, as shown in FIG. 26D, the portion, corresponding to the orifice 41 shown in FIGS. 1 and 2, of the end face of the projection 48*c* is irradiated with the laser beam 13 to form a hole penetrating through the resinous film 3 in the projection 48*c* as shown in FIGS. 26E and 26F, whereby an orifice 41 with an aperture diameter of 25 $\mu$m at the side of the projection 45 and an aperture diameter of 20 $\mu$m at a side opposite to the projection 45 is formed on the resinous film 3.

Figure 27B:
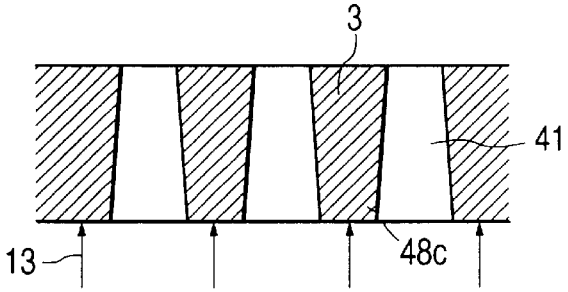
Figure 27C:
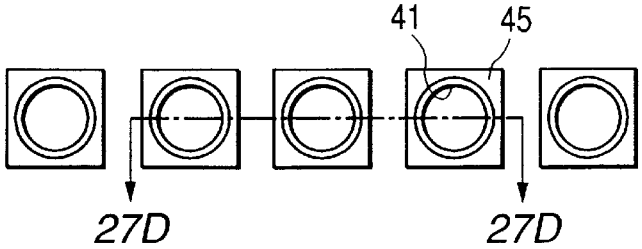
Figure 27D:
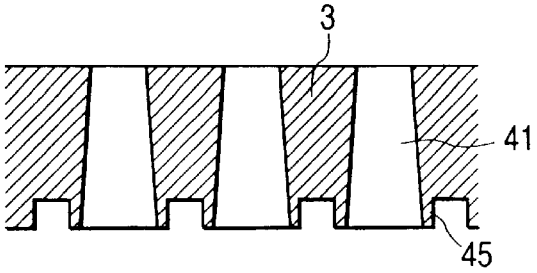

Then, as shown in FIG. 27B, the unnecessary portions of the projection 48*c* are eliminated by irradiating the portions excluding the portions corresponding to the orifices 41 and the projections 45 on the end face of the projection 48*c* with the laser beam 13, thereby forming independent plural projections 45 respectively corresponding to the orifices 41 as shown in FIGS. 27C and 27D. Also in the present embodiment, as in the twelfth embodiment, the projections 45 and the orifices 41 are formed with the laser working apparatus of the third embodiment shown in FIG. 9.

Then, the resinous film 3 sound in a roll after the formation of the orifices 41 and the projections 45 is cut into a size of 4 inches required for each liquid discharge head, thereby obtaining the orifice plate shown in FIGS. 1 and 2.

Then, as explained in the first embodiment, the projections 45 of the orifice plate 40 are made to enter the liquid paths 61 of the head main body 46 and the orifice plate 40 is adjoined to the head main body 46 with the epoxy adhesive whereby obtained is the liquid discharge head explained with reference to FIGS. 1 and 2.

According to the method of the present embodiment, as in the first embodiment, each orifice plate 40 is not prepared in divided manner but in an integral structure, so that even the orifice plate 40 with a large number of orifices 41 can be obtained without any joint therein and with satisfactory dimensional precision of the orifices 41 and the projections 45. Thus there can be avoided the defect that the projections 45 of the orifice plate 40 cannot be fitted with the liquid paths 61 of the head main body 46. Also the recording with thus prepared liquid discharge head was free from defects such as deviation of the flying liquid droplets or non-uniformity in the recorded image, resulting from the defects in the joint in the orifice plate, encountered when the orifice plate is prepared in divided manner and provided satisfactory recording quality.

Fourteenth Embodiment

In the following a fourteenth embodiment of the present invention will be explained with reference to the attached drawings.

Figure 28:
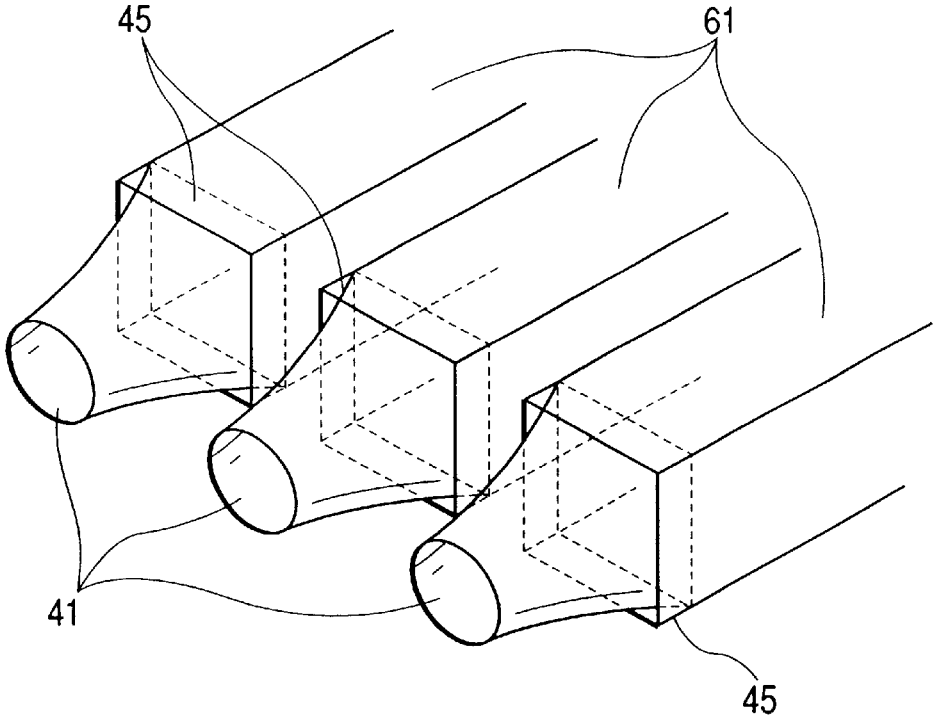
FIG. 28 is a perspective view of a portion of the orifice and the liquid path in the liquid discharge head in the fourteenth embodiment of the present invention.

FIG. 28 is an exploded perspective view of the liquid discharge head in which the present invention is applied. In the present embodiment, portions similar to those in the foregoing first embodiment will not be explained further.

In the present embodiment, the aperture of the orifice 41 at the side of the projection 45 is rectangular, similar to the cross sectional shape of the liquid path, and, is circular or oval at the side discharging liquid droplet. Also the orifice has a curved shape smoothly narrowing from the side of the head main body in the liquid droplet discharging direction, and such shape can improve the discharge efficiency.

FIGS. 29A to 29F are views showing the method for producing the projection and the orifice of the present embodiment on the resinous film by the manufacturing line shown in FIG. 3 and the laser working apparatus shown in FIG. 9.

Figure 29A:
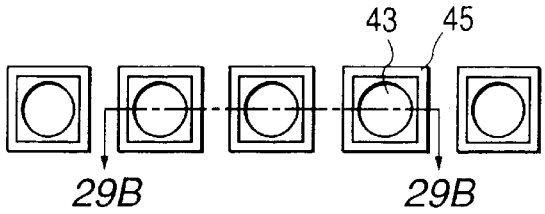
FIGS. 29A, 29B, 29C, 29D, 29E and 29F are views showing the producing method for the projection and the orifice on the resinous film prepared by the manufacturing line shown in FIG. 3 and by the laser working apparatus shown in FIG. 9.
Figure 29B:
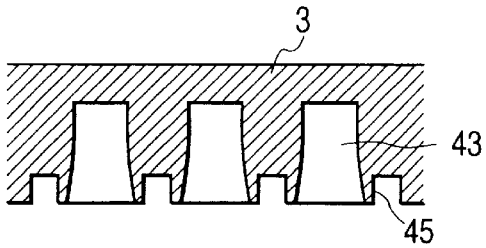
Figure 29C:
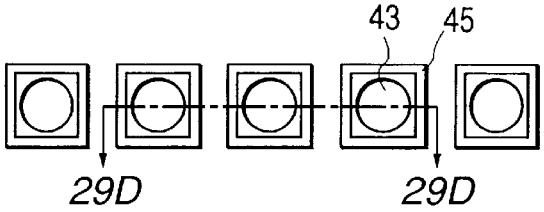
Figure 29D:
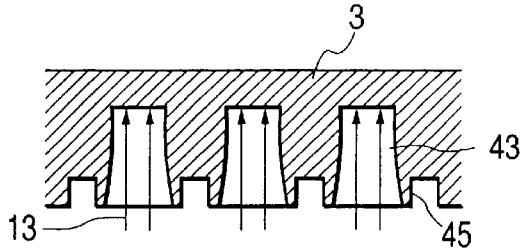
Figure 29E:
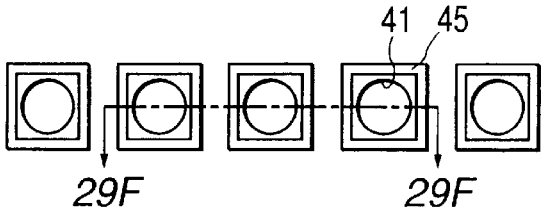
Figure 29F:
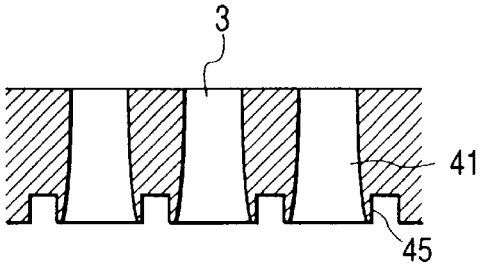

At first, as shown in FIGS. 29A and 29B, independent plural projections 45 and plural recesses 43, respectively positioned in the centers of the projections 45 and having a cross section varying continuously from a rectangular shape to a circular shape, are formed on the resinous film 3 in continuous manner in the extruding direction thereof, by the relief mold 4 provided on the cooling roller 5. Each recess 43 is used for forming the orifice 41. Then, as shown in FIGS. 29C and 29D, the bottom face of each recess 43 is irradiated with the laser beam 13 to form a hole penetrating through the resinous film 3 in the bottom face of each recess 43, as shown in FIGS. 29E and 29F. In this manner the orifice 41 is formed in the resinous film 3. The thickness of the bottom of the recess 43 should be as small as possible, preferably not exceeding 20 $\mu$m, more preferably not exceeding 10 $\mu$m and most preferably not exceeding 5 $\mu$m. When the thickness does not exceed 5 $\mu$m, the entire bottom face of the recess can be irradiated without executing alignment.

Thus obtained resinous film in the reeled form is cut into a size required for each liquid discharge head, whereby the orifice plate 40 for each head can be prepared.

The laser irradiation for forming the penetrating hole may be made in a portion corresponding to the orifice, from the back surface of the resinous film opposite to the surface bearing the projection 45. In such case, the thickness of the bottom face of the recess is preferably 5 $\mu$m or less, more preferably 3 $\mu$m or less.

In the following there will be explained the mode of preparation of the liquid discharge head after the formation of the orifice plate, with reference to FIG. 1.

Cation-polymerizable epoxy adhesive, that can be shifted to a B-stage while retaining tucking property by UV irradiation, and, after hardening with shrinkage, can achieve adhesion of components by pressing under heating, is transferred by a transfer method onto the adjoining faces 44*a*, 44*b* of the head main body, having the apertures of the liquid paths 61. Then the transferred adhesive is irradiated with ultraviolet light of 1 mW/cm$^2$ for 60 seconds to shift the adhesive to the B-stage state, thereby completing the hardening with shrinkage.

Then the projections 45 of the orifice plate 40 are respectively inserted into the corresponding liquid paths 61 of the head main body 46 having the liquid paths 61, base plate 50 and ceiling plate 60.

Then a load of 1 kg/cm$^2$ is applied to the orifice plate 40 on the surface thereof, thereby maintaining the orifice plate 40 and the head main body 46 in close contact, and, while such state is maintained, the heating is conducted at 60° C. thereby completing the hardening of the adhesive.

The present embodiment employs, for adhering the orifice plate and the head main body, epoxy adhesive that can be shifted to the B-stage to complete hardening with shrinkage by UV irradiation while maintaining the tucking property, and that can be hardened by additional UV irradiation or heating. This adhesive can also be adhered by pressing under heating only.

Embodiment

Figure 30A:
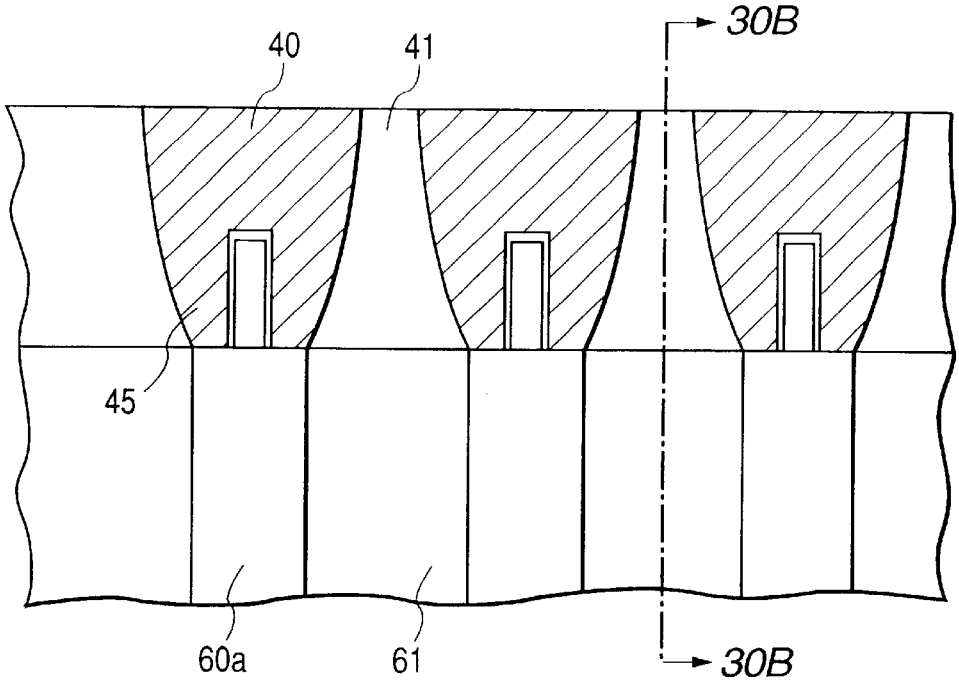
FIGS. 30A and 30B are respectively a plan view and a cross-sectional view, along a line 30B—30B in the plan view, showing the configuration of the orifice or the orifice plate in the fourth embodiment of the present invention.
Figure 30B:
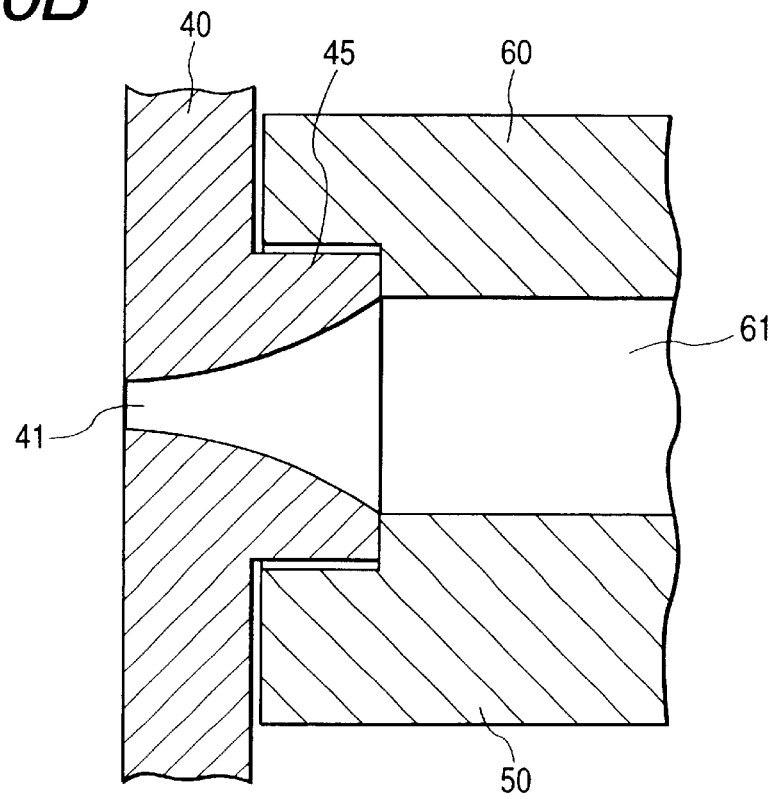

FIGS. 30A and 30B are respectively a plan view and a cross-sectional view along a line 30B—30B in FIG. 30A, showing the configuration of orifices of the orifice plate in an embodiment of the present invention.

Figure 31:
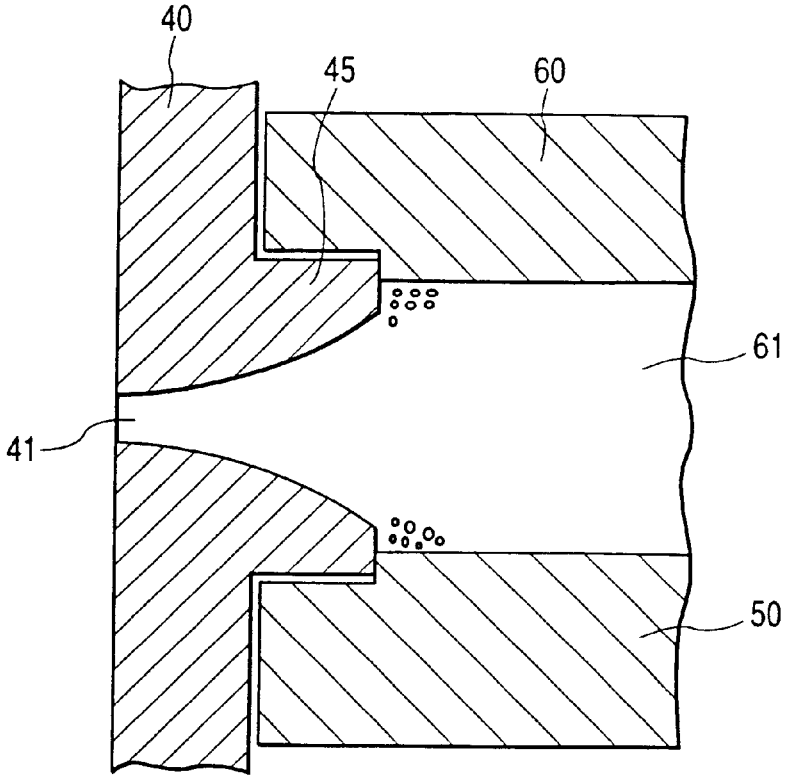
FIG. 31 is a view showing a state in which the adjoining face of the projection of the orifice plate protrudes toward the ink flow path.
Figure 33:
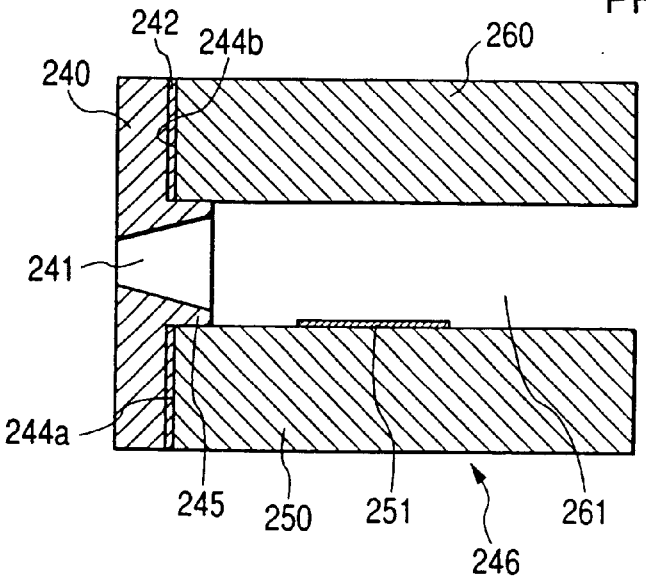
FIG. 33 PRIOR ART
FIG. 33 is a perspective view showing the liquid discharge head provided in the conventional ink jet recording apparatus.

In this embodiment, projection 45 of the orifice plate 40, fitted in the liquid paths 61, has a structure coming in close contact with the liquid path wall 61, base plate 50 and ceiling plate 60 in a plane perpendicular to the ink flow. The projection 45 may be in contact in at least two faces of the liquid path wall 60*a*, base plate 50 and ceiling plate 60. As shown in FIG. 31, the contact face of the projection 45 of the orifice plate 40 is so structured as not to protrude toward the ink liquid path. Such structure enables smooth ink flow and prevents formation of bubble trapping.

In this embodiment, the orifice plate 40 is provided with a recess and a projection 45 in the adjoining face with the head main body 46, and the projection 45 has a shape matching the cross-sectional shape of the liquid path 61 and is provided with the orifice 41, and the projection 45 or a part thereof is inserted into and is fitted with the liquid path 61 of the head main body 46.

Other Embodiments

Figure 32:
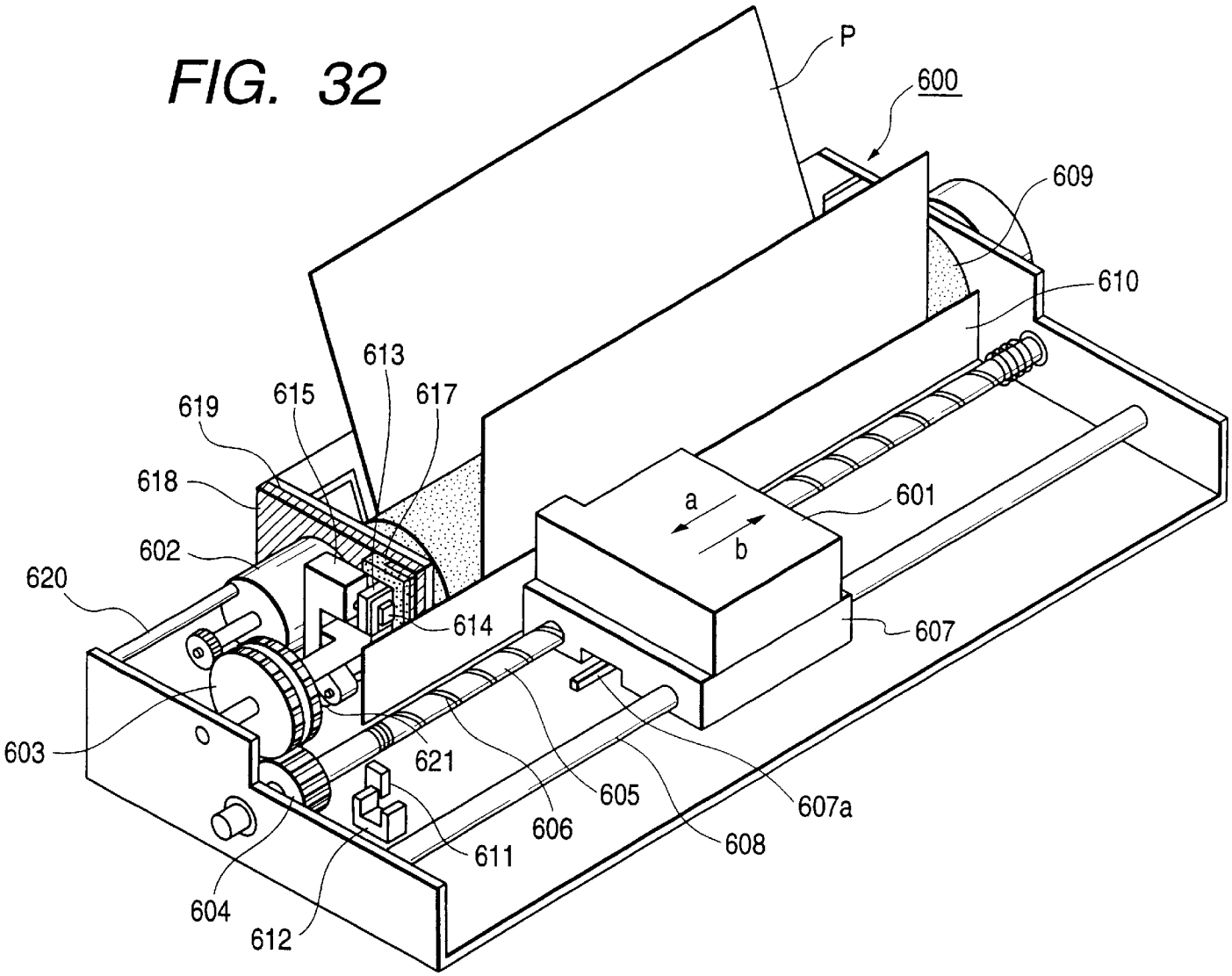
FIG. 32 is a perspective view showing an example of the liquid discharge recording apparatus loaded with the liquid discharge head employing the orifice plate prepared by the method of the present invention.

FIG. 32 is a perspective view showing an ink jet recording apparatus, constituting an example of the liquid discharge recording apparatus, employing the liquid discharge head prepared with the above-described orifice plate. A head cartridge 601, mounted on the ink jet recording apparatus 600 shown in FIG. 32, includes a liquid discharge head prepared with the above-described orifice plate and a liquid container containing liquid to be supplied to the liquid discharge head. As shown in FIG. 32, the head cartridge 601 is mounted on a carriage 607, engaging with a spiral groove 606 of a lead screw 606, rotating through transmission gears 603, 604 in the forward or reverse direction by a driving motor 602. The power of the driving motor 602 reciprocates the head cartridge 601 together with the carriage 607 in directions a and b along a guide member 608. The ink jet recording apparatus 600 is provided with recording medium transport means (not shown) for transporting a recording medium, such as a print sheet P, for receiving the liquid such as ink discharged from the head cartridge 601. A pressure plate 610 presses the print sheet P, transported on a platen 609 by the recording medium transport means, toward the platen 609 over the moving range of the carriage 607.

In the vicinity of an end of the lead screw 605, there are provided photocouplers 611, 612 which constitute home position detecting means for detecting the presence of a lever 607*a* of the carriage 607 in the area of the photocouplers 611, 612 and switching the rotating direction of the driving motor 602. In the vicinity of an end of the platen 609, there is provided a support member 613 for supporting a cap member 614 which covers the front face, having the orifices, of the head cartridge 601. There is also provided ink suction means 615 for sucking the ink idly discharged from the head cartridge 601 and accumulated in the interior of the cap member 614. The ink suction means 615 executes suction recovery of the head cartridge 601 through the aperture of the cap member 614.

The ink jet recording apparatus 600 is also provided with a main body support member 619, which supports a movable member 618 in movable manner in the front-back direction, namely in a direction perpendicular to the moving direction of the carriage 607. A cleaning blade 617 is mounted on the movable member 618. The cleaning blade 617 is not limited to the illustrated form but may assume other known forms. There is also provided a lever 620 for starting the suction at the suction recovery operation by the ink suction means 615, and the lever 620 is moved by a cam 621 engaging with the carriage 607 and is controlled by the driving force of the motor 602 through known transmission means such as a clutch. An ink jet recording control unit, for supplying the heat generating members provided in the head cartridge 601 with driving signals and controlling the functions of the above-described mechanisms is provided in the main body of the ink jet recording apparatus and is not shown in FIG. 32. The ink jet recording control unit is provided with a drive signal supply means for supplying the drive signals for causing the liquid discharge head to discharge liquid.

The ink jet recording apparatus 600 of the above-described configuration executes recording on the print sheet P, transported on the platen 609 by the aforementioned recording medium transport means, by the reciprocating motion of the head cartridge P over the entire width of the print sheet P.

What is claimed is:

1. A method for producing a liquid discharge head, comprising a plurality of flow paths in which a plurality of energy generating elements for generating energy to cause liquid to be discharged as a flying liquid droplet are respectively provided, and a plurality of discharge ports respectively communicating with the plurality of flow paths, said method comprising:

a step of continuously forming a plurality of projections corresponding to an array of the plurality of discharge ports along a longitudinal direction of a film;

a step of forming a plurality of openings penetrating the projections, in a projecting direction of the projections;

a step of separating the film in a predetermined size including a portion on which the openings are formed; and a step of adjoining the film to the liquid discharge head so as to make the openings become the discharge ports by inserting the projections into the flow paths to make engagement therebetween using the film separated in the separating step as an orifice plate of the liquid discharge head.

2. A method for producing a liquid discharge head according to claim 1, wherein a water-repellent layer is formed on a surface of the film opposite to a surface on which the plural projections are formed.

3. A method for producing a liquid discharge head according to claim 1, further comprising an extrusion molding step, wherein fused resin is extruded in a shape of the film on which the plural projections are to be formed.

4. A method for producing a liquid discharge head according to claim 3, wherein the plural openings and the plural projections are formed simultaneously.

5. A method for producing a liquid discharge head according to claim 4, further comprising a step of pressing a surface of the fused resin with a roller having a relief mold of a predetermined shape, thereby cooling the fused resin extruded in the shape of the film in said extrusion molding step.

6. A method for producing a liquid discharge head according to claim 3, further comprising a step of pressing a surface of the fused resin with a roller having a relief mold of a predetermined shape, thereby cooling the fused resin extruded in the shape of the film in said extrusion molding step.

7. A method for producing a liquid discharge head according to claim 1, wherein a thermoplastic polymer is employed as a material of the film.

8. A method for producing a liquid discharge head according to claim 1, wherein any one of polysulfone, polyethersulfone, polyphenylene sulfide and polyetherketone is employed as a material of the film.

9. A method for producing a liquid discharge head according to claim 1, further comprising a step of winding the film with the projections being arranged on an outer circumferential surface of the film, after said projection forming step.

* * * * *